US011600898B2

(12) United States Patent
Heath et al.

(10) Patent No.: US 11,600,898 B2
(45) Date of Patent: Mar. 7, 2023

(54) ROOF TOP SECTOR FRAME

(71) Applicant: CommScope Technologies LLC, Hickory, NC (US)

(72) Inventors: Dale Richard Heath, Fort Worth, TX (US); Robert Campbell, Irving, TX (US); Firoz Ahmed, Irving, TX (US); Jyoti Ojha, Euless, TX (US)

(73) Assignee: CommScope Technologies LLC, Hickory, NC (US)

( * ) Notice: Subject to any disclaimer, the term of this patent is extended or adjusted under 35 U.S.C. 154(b) by 85 days.

(21) Appl. No.: 16/906,353

(22) Filed: Jun. 19, 2020

(65) Prior Publication Data

US 2020/0411945 A1 Dec. 31, 2020

Related U.S. Application Data

(60) Provisional application No. 62/867,469, filed on Jun. 27, 2019.

(51) Int. Cl.
*H01Q 1/12* (2006.01)
*E04B 7/18* (2006.01)

(52) U.S. Cl.
CPC *H01Q 1/12* (2013.01); *E04B 7/18* (2013.01)

(58) Field of Classification Search
CPC .. H01Q 1/08; H01Q 1/10; H01Q 1/12; H01Q 1/1207; H01Q 1/1221; H01Q 1/1235; H01Q 1/1242; H01Q 1/125; H01Q 1/1264; H01Q 1/20; E04B 7/18
See application file for complete search history.

(56) References Cited

U.S. PATENT DOCUMENTS 4,649,675 A * 3/1987 Moldovan ..... E04H 3/00 52/27
5,142,293 A * 8/1992 Ross ..... H01Q 1/1221 343/878
5,533,304 A * 7/1996 Noble ..... H01Q 1/125 52/114
5,787,673 A * 8/1998 Noble ..... H01Q 1/1242 52/114
5,920,291 A * 7/1999 Bosley ..... H01Q 1/1207 343/890
5,971,345 A * 10/1999 Khalaf ..... H01Q 1/1228 343/890

(Continued)

*Primary Examiner* — Jason Crawford
(74) *Attorney, Agent, or Firm* — Myers Bigel, P.A.

(57) ABSTRACT

The present disclosure is directed to mounts for antennas and radio equipment, and more particularly to mounts for antennas on and radio equipment on the top of a building or commercial structure. One aspect of the present disclosure is directed to a sector frame. The sector frame may have a plurality of structural members, including antenna pipes for the mounting of electronic equipment, and a face pipe along which the antenna pipes are disposed. In some embodiments, the antenna pipes and the face pipe may form an antenna pipe array which is rotatable about three perpendicular axes. Another aspect of the present disclosure is directed to a method for adapting a sector frame to a substrate. The method includes the step of attaching an extension to a base of the sector frame, wherein a portion of the base of the sector frame is in contact with the substrate, and wherein a portion of the extension is in contact with the substrate.

16 Claims, 26 Drawing Sheets

(56) References Cited

U.S. PATENT DOCUMENTS 5,979,844 A * 11/1999 Hopkins ..... E01F 9/692 248/910
6,088,002 A * 7/2000 Johnson ..... H01Q 19/108 343/890
6,229,497 B1 * 5/2001 McCracken ..... E04G 21/3238 343/890
6,276,649 B1 * 8/2001 Kruse ..... H01Q 1/1221 248/346.03
7,027,007 B2 * 4/2006 Hossein ..... H01Q 1/246 343/890
7,113,145 B1 * 9/2006 Noble ..... H01Q 1/1228 343/890
7,659,865 B2 * 2/2010 Kreitzberg ..... H01Q 1/1235 343/890
8,413,391 B2 * 4/2013 Seery ..... F24S 25/70 52/173.3
9,118,106 B2 * 8/2015 Adams ..... H01Q 1/12
10,374,117 B2 * 8/2019 Wolter ..... F24S 25/65
10,634,122 B1 * 4/2020 Clifton ..... E04H 12/345
2003/0016183 A1 * 1/2003 Pyanowski ..... H01Q 1/44 343/878
2003/0076273 A1 * 4/2003 Cockell ..... H01Q 1/1207 343/878
2005/0057427 A1 * 3/2005 Wensink ..... H01Q 3/005 343/882
2006/0016947 A1 * 1/2006 Capozzi ..... H01Q 1/1221 248/284.1
2006/0087476 A1 * 4/2006 Piburn ..... H01Q 1/246 343/890
2007/0205957 A1 * 9/2007 Chapman ..... H01Q 1/1228 343/871
2007/0247381 A1 * 10/2007 Runte ..... H01Q 1/52 343/720
2007/0261355 A1 * 11/2007 Carlisle ..... H01Q 1/1242 52/633
2008/0278402 A1 * 11/2008 Kreitzberg ..... H01Q 1/1235 343/880
2010/0115856 A1 * 5/2010 Carlisle ..... H01Q 1/1242 52/173.1
2011/0095956 A1 * 4/2011 Conrad ..... H01Q 1/12 343/840
2011/0279347 A1 * 11/2011 Pass ..... E04G 3/243 343/890
2012/0175322 A1 * 7/2012 Park ..... F16B 5/0635 248/299.1
2013/0127686 A1 * 5/2013 Fruh ..... H01Q 19/12 343/887
2015/0057047 A1 * 2/2015 Hendrix ..... H04B 1/40 455/562.1
2015/0197957 A1 * 7/2015 Anderson ..... E04H 12/2246 52/126.5
2016/0211569 A1 * 7/2016 Skrepcinski ..... H01Q 1/1228
2016/0302078 A1 * 10/2016 Sivanandar ..... H01Q 1/246
2016/0322697 A1 * 11/2016 Skrepcinski ..... H01Q 1/125
2018/0026327 A1 * 1/2018 Hendrix ..... H01Q 1/1228 455/562.1
2018/0083337 A1 * 3/2018 Roy ..... H01Q 1/1228
2020/0411945 A1 * 12/2020 Heath ..... H01Q 1/12
2022/0037768 A1 * 2/2022 Zimmerman ..... H01Q 21/08
2022/0190462 A1 * 6/2022 Campbell ..... H01Q 1/125

* cited by examiner

ROOF TOP SECTOR FRAME

RELATED APPLICATION

This application claims priority from and the benefit of U.S. Provisional Patent Application No. 62/867,469, filed Jun. 27, 2019, the disclosure of which is hereby incorporated herein in its entirety.

FIELD OF THE INVENTION

The present invention relates generally to mounts for antennas and radio equipment, and more particularly to mounts for antennas and radio equipment on the top of a building or commercial structure.

BACKGROUND OF THE INVENTION

With increased demand for more wireless communication, the number of radio and antenna units that a rooftop sector frame must support has increased and is expected to continue to increase. Many antennas are also becoming larger to handle more wireless traffic. In addition to increasing load demands, there is an increasing need for adaptability of a sector frame to different installation environments. For instance, some installations may also need to be leveled on sloped commercial building tops. Different rooftops may require alternative anchoring mechanisms, such as by bolting the frame directly to the rooftop or, in a non-penetrating design, by loading the frame with ballast in a ballast sled with a ballast tray.

One parameter that influences antenna design is Effective Projected Area ("EPA"), which may be calculated according to TIA/ANSI-222-H. EPA is intended to predict the effect of wind loading on an antenna structure to assist designers in evaluating the strength requirements for a frame. The configuration of the antenna mount can impact the EPA. In particular, increasing the number of components in a frame may increase the EPA in some cases.

Therefore, there may be a need for rooftop sector frames which meet target strength and EPA requirements while offering increased adaptability.

SUMMARY

As a first aspect, embodiments of the invention are directed to a method for adapting a sector frame to a substrate, comprising the step of attaching an extension to a base of the sector frame, wherein a portion of the base of the sector frame is in contact with the substrate, and wherein a portion of the extension is in contact with the substrate.

As a second aspect, embodiments of the present disclosure are directed to a method for orienting a sector frame on a substrate comprising the step of manipulating a plurality of adjustable joints of the sector frame to orient an antenna pipe in a substantially vertical orientation. The sector frame may comprise a plurality of structural members. The plurality of structural members may include the antenna pipe for the mounting of electronic equipment and a face pipe along which the antenna pipe is disposed. The antenna pipe and the face pipe may form an antenna pipe array. The sector frame may also comprise a base forming a base contact surface with a substrate. The plurality of adjustable joints of the sector frame may be operable to provide rotation of the antenna pipe array in at least two directions selected from: rotation about a normal axis, the normal axis being normal to the substrate; rotation about a transverse axis perpendicular to the normal axis; and rotation about a longitudinal axis perpendicular to both the normal axis and the transverse axis.

As a third aspect, embodiments of the present disclosure are directed to a sector frame comprising a plurality of structural members. The plurality of structural members may include an antenna pipe for the mounting of electronic equipment and a face pipe along which the antenna pipe is disposed. The antenna pipe and the face pipe may form an antenna pipe array. The sector frame may also comprise a base forming a base contact surface with a substrate. The plurality of adjustable joints of the sector frame may be operable to provide rotation of the antenna pipe array in at least two directions selected from: rotation about a normal axis, the normal axis being normal to the substrate, rotation about a transverse axis perpendicular to the normal axis, and rotation about a longitudinal axis perpendicular to both the normal axis and the transverse axis.

DETAILED DESCRIPTION

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete and will fully convey the scope of the invention to those skilled in the art. It will also be appreciated that the embodiments disclosed herein can be combined in any way and/or combination to provide many additional embodiments.

Unless otherwise defined, all technical and scientific terms that are used in this disclosure have the same meaning as commonly understood by one of ordinary skill in the art to which this invention belongs. The terminology used in the below description is for the purpose of describing particular embodiments only and is not intended to be limiting of the invention. As used in this disclosure, the singular forms "a", "an", and "the" are intended to include the plural forms as well, unless the context clearly indicates otherwise. It will also be understood that when an element (e.g., a device, circuit, etc.) is referred to as being "connected" or "coupled" to another element, it can be directly connected or coupled to the other element or intervening elements may be present. In contrast, when an element is referred to as being "directly connected" or "directly coupled" to another element, there are no intervening elements present.

Figure 1:
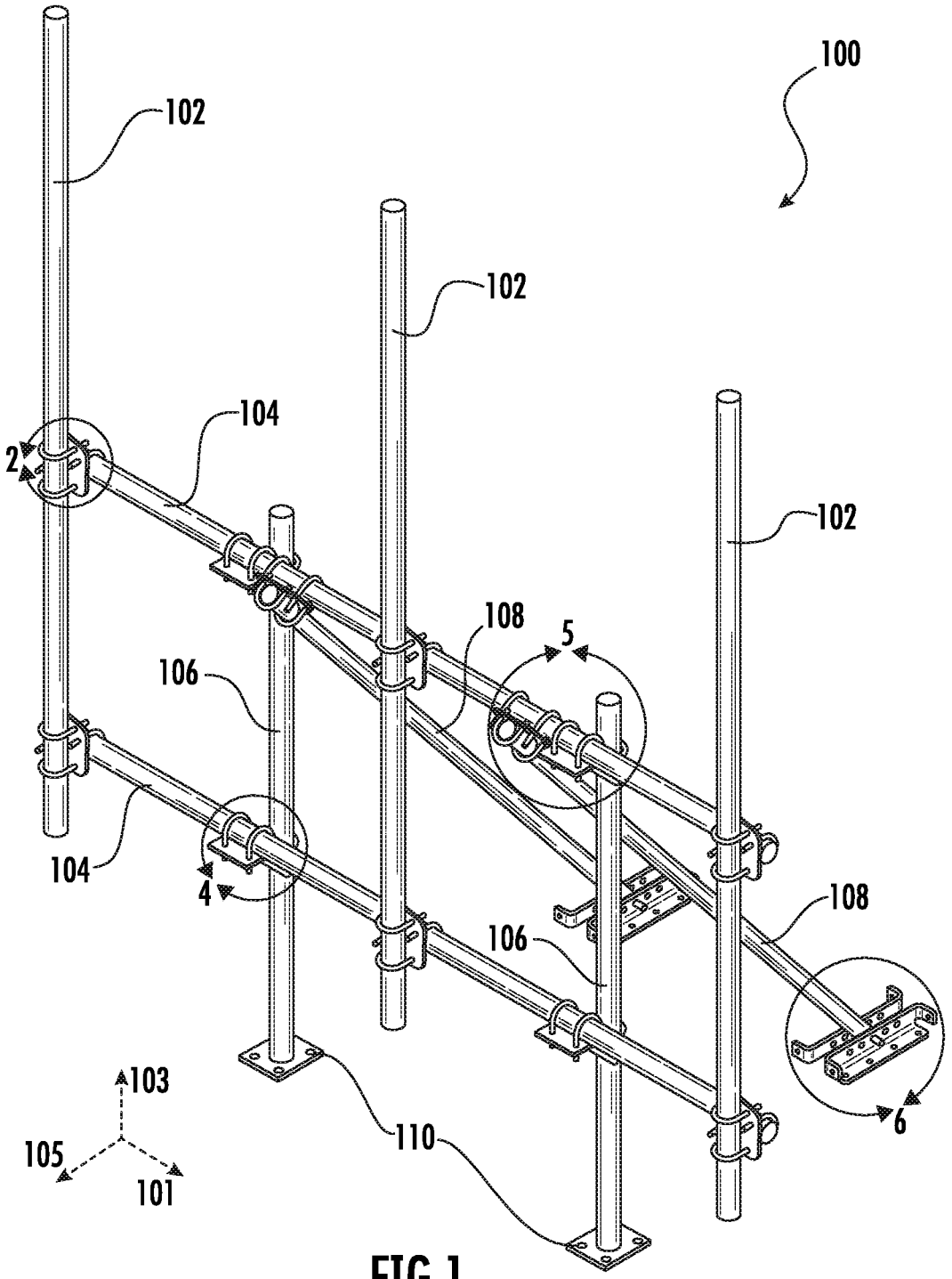
FIG. 1 is a front perspective view of one embodiment of a rooftop sector frame of the present invention.

Referring now to FIG. 1, an embodiment of the present invention includes a rooftop sector frame 100. In general, the rooftop sector frame 100 is assembled from structural members, which may include tubes, pipes, bars, rods, extruded components, beams, weldments, folded sheet components, and the like. The exemplary rooftop sector frame 100 contains antenna pipes 102 generally oriented in a direction normal to the underlying surface or substrate (i.e., along a normal axis 103). The antenna pipes 102 are disposed along face pipes 104 which are generally oriented in a transverse direction (i.e., along a transverse axis 101). The face pipes 104 are disposed along posts 106, which each generally terminate at a lower end with a post bracket 110. Tieback pipes 108 may provide support to the rooftop sector frame 100 by providing additional anchor points spaced apart from the post brackets 110, such as behind the post brackets 110 (i.e., spaced along a longitudinal axis 105).

Figure 2:
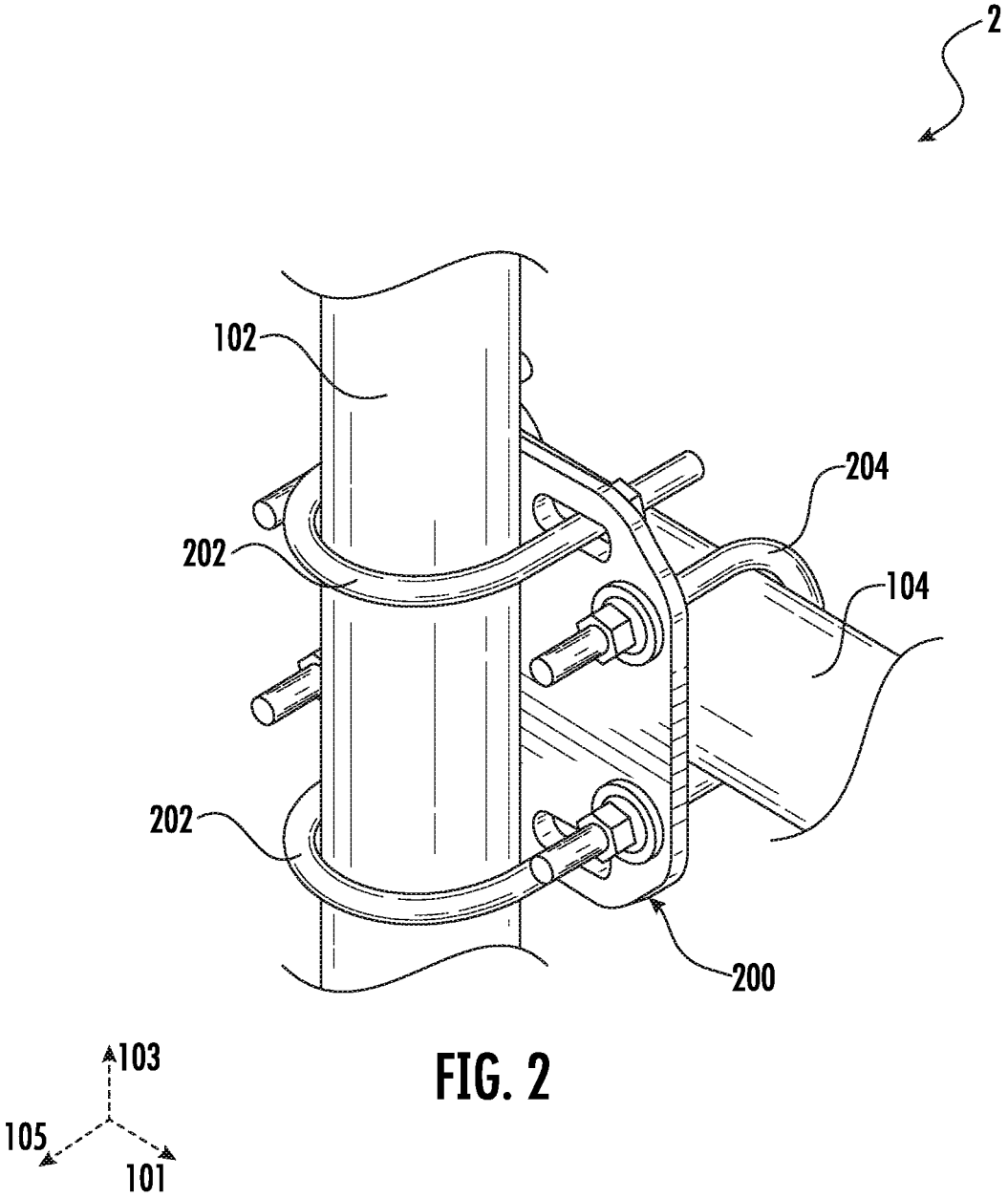
FIG. 2 is an enlarged view of a crossover plate of the rooftop sector frame of FIG. 1.

The antenna pipes 102 may connect to the face pipes 104 at a joint 2, which is shown enlarged in FIG. 2. The joint 2 may contain a crossover plate 200, to which fasteners (e.g., U-bolts 202) attach a first pipe (e.g., the antenna pipe 102) and fasteners (e.g., U-bolts 204) attach a second pipe (e.g., the face pipe 104). When the U-bolts 202 and 204 are loosened, the antenna pipe 102 and the face pipe 104 may optionally be slideable along axes 103 and 101, respectively. Furthermore, the joint 2 may rotate about the face pipe 104 (i.e., pitch around the transverse axis 101).

Figure 3:
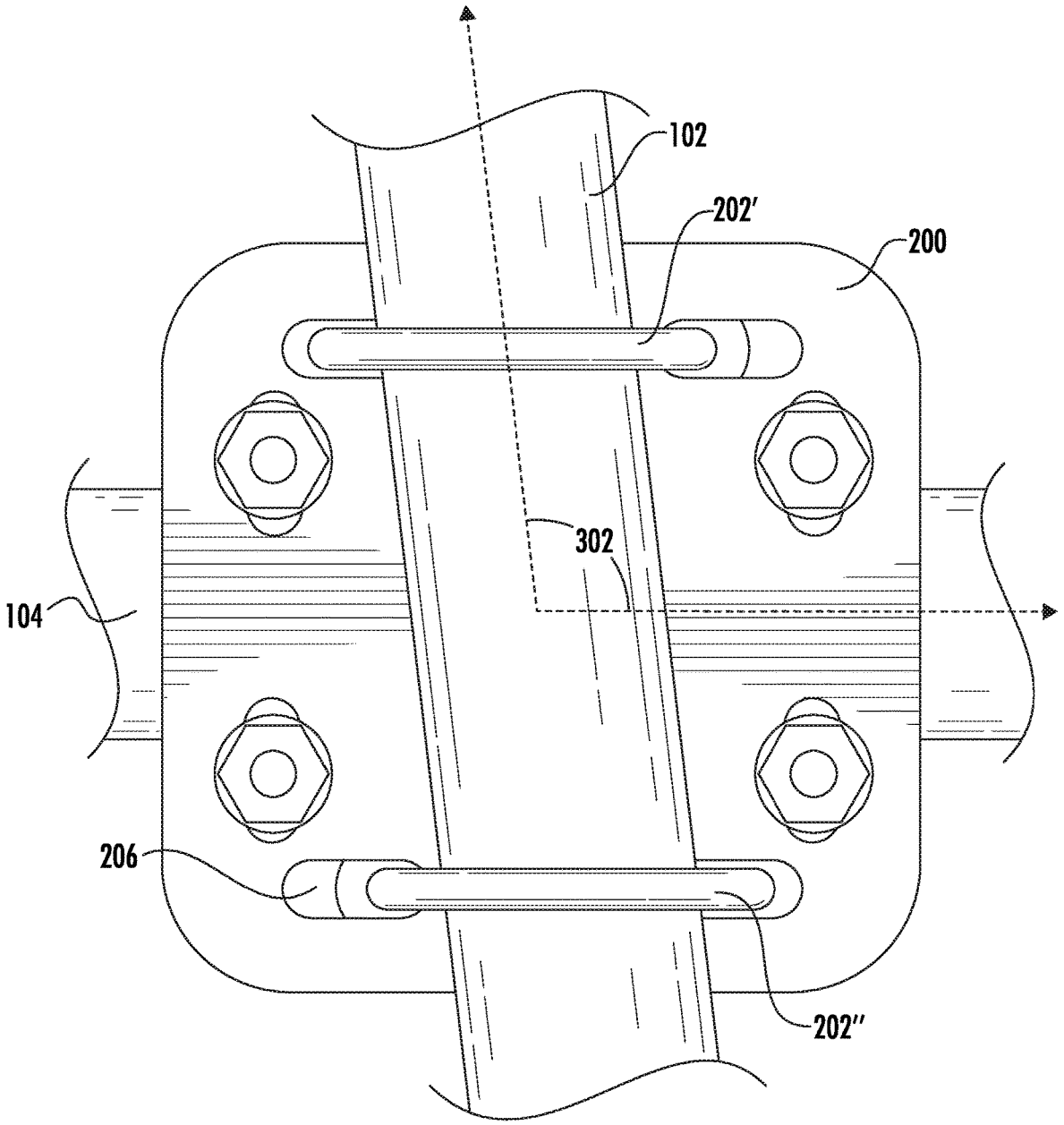
FIG. 3 is an enlarged view of the crossover plate of FIG. 2 in an angled configuration.

The joint 2 may also permit the pipes connected to it (here, the antenna pipe 102 and the face pipe 104) to tilt in the roll direction (i.e., around the longitudinal axis 105). For instance, as shown in FIG. 3, the antenna pipe 102 may be mounted at a variable angle 302 with respect to the face pipe 104 by staggering the placement of the upper U-bolt 202' and the lower U-bolt 202", which cooperatively hold the antenna pipe 102 to the crossover plate 200. Elongated mounting slots 206 in the crossover plate 200 may permit the U-bolts 202' and 202" to be repositioned in a variety of positions. In some embodiments, however, the crossover plate 200 may contain a series of individual round holes placed to enable the selection of a predetermined angle 302 by choosing the corresponding set of mounting holes for a pair of upper and lower U-bolts 202' and 202".

Figure 4:
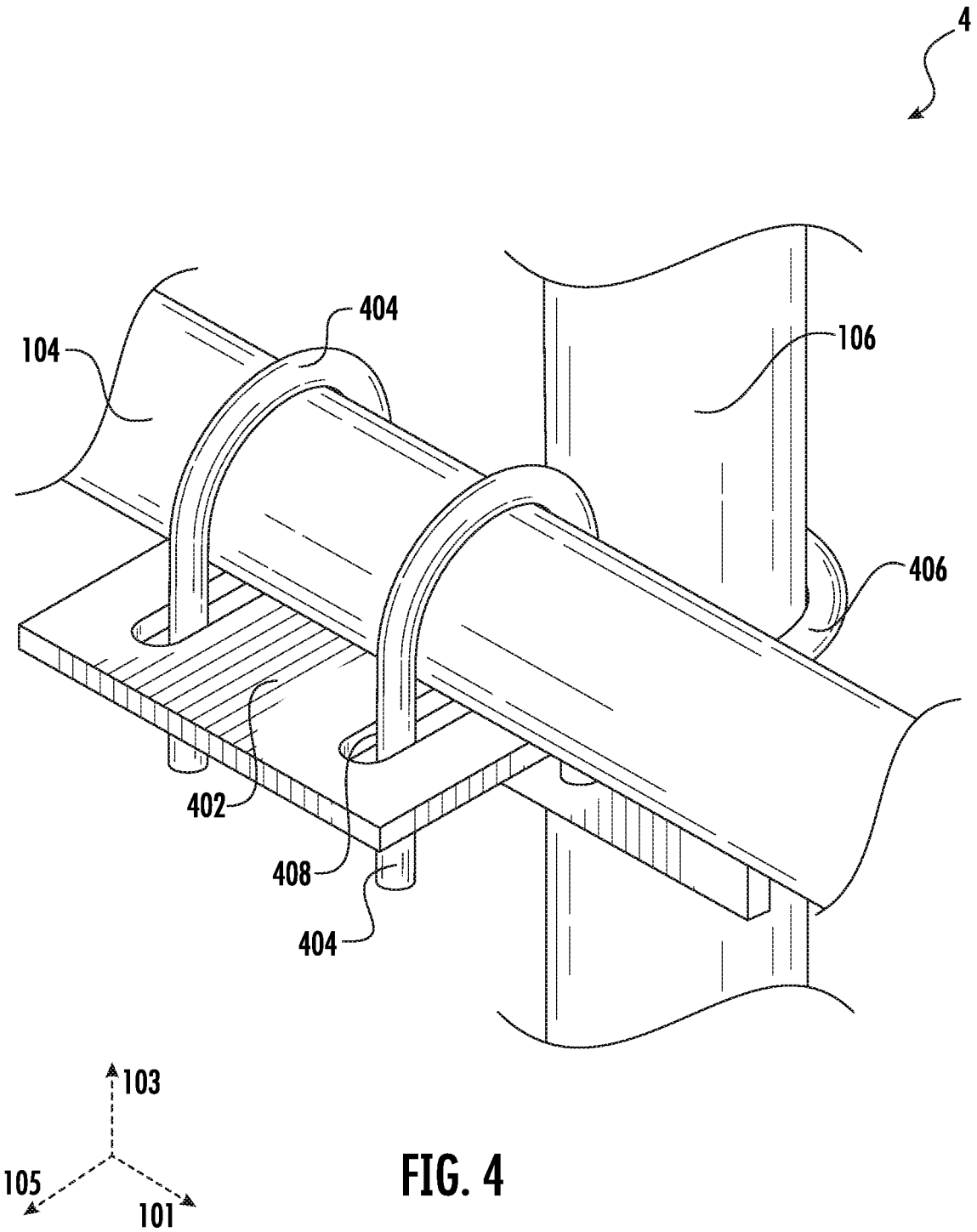
FIG. 4 is an enlarged view of a lower L-bracket of the rooftop sector frame of FIG. 1.

Referring again to FIG. 1, the face pipes 104 may connect to the posts 106 at a joint 4 (i.e., an adjustable post joint 4), which is shown enlarged in FIG. 4. A joint 4 generally includes an angle bracket (e.g., an L-bracket 402) to which a first pipe (e.g., a face pipe 104) is connected by U-bolts 404 and a second pipe (e.g., a post 106) is connected by U-bolts 406. Just as with the crossover plate 200, the pipes 104 and 106 may slide along the axes 101 and 103, respectively, and the L-bracket 402 may enable the tilting of the connected pipes in the same manner as exemplified by the crossover plate 200 in FIG. 3. For instance, the face pipe 104 may rotate around the normal axis 103 (i.e., yaw) if its securing U-bolts 404 are adjusted. Alternatively, or additionally, the U-bolts 406 may be staggered, causing the face pipe 104 to rotate around the longitudinal axis 105 (i.e., roll) relative to the post 106. Alternatively, or additionally, the U-bolts 404 may be moved in unison in an elongated slot 408 along the longitudinal axis 105, thereby adjusting the distance between the face pipe 104 and the post 106 in the direction of the longitudinal axis 105.

Figure 5:
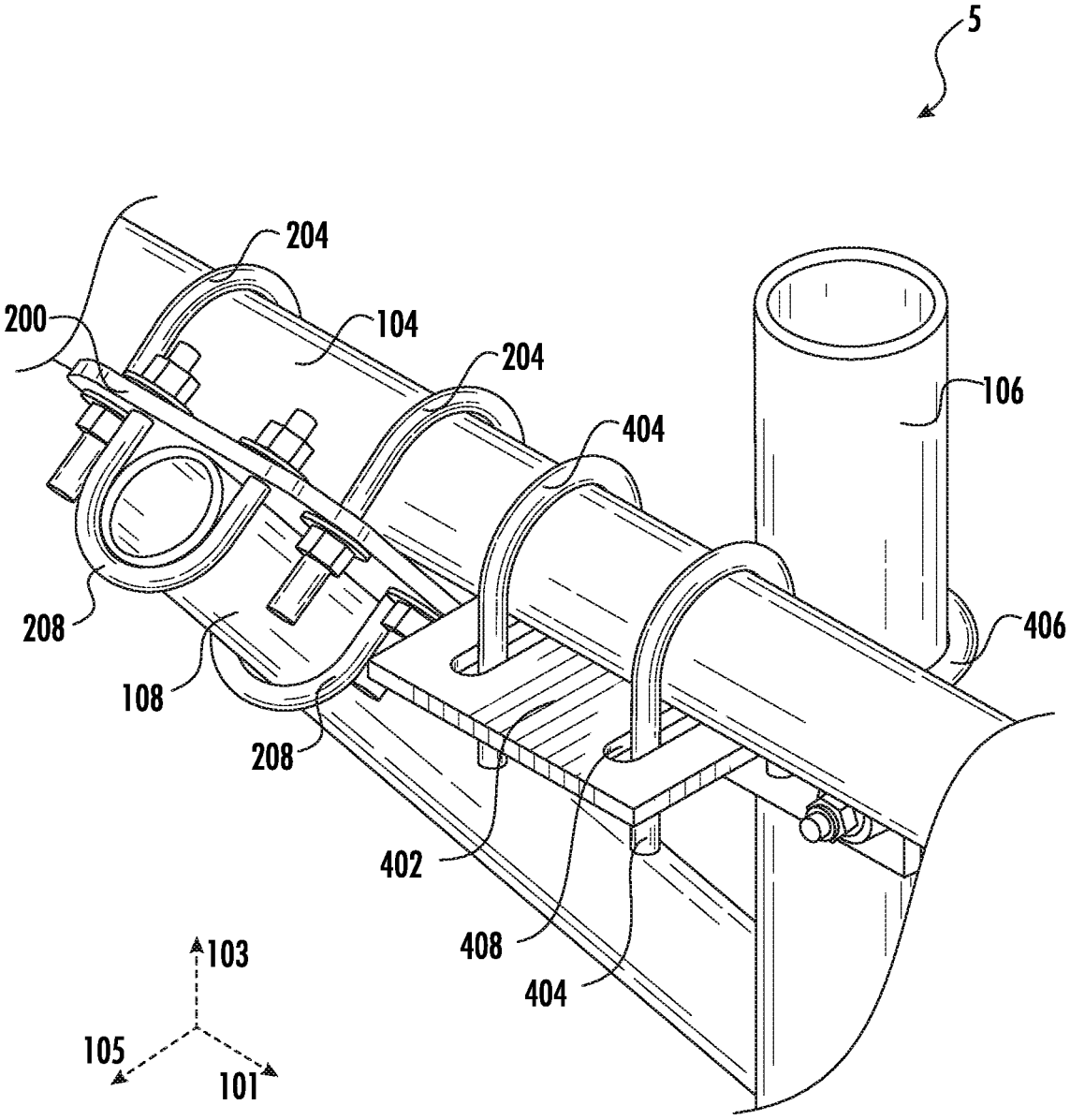
FIG. 5 is an enlarged view of an upper L-bracket and a second crossover plate of the rooftop sector frame of FIG. 1.

Referring again to FIG. 1, the face pipes 104 and/or the posts 106 may connect to the tieback pipes 108 at a joint 5 (i.e., an adjustable post joint 5), which is shown enlarged in FIG. 5. As depicted in FIG. 5, the face pipe 104 connects to the post 106 at another instance of a joint 4 (i.e., using an L-bracket 402). The joint 5 also includes a crossover plate 200 connecting the face pipe 104 to the tieback pipe 108 in the same manner as in a joint 2. As with a joint 2, and as described in relation to FIGS. 2 and 3, the face pipe 104 and the tieback pipe 108 may slide and tilt in relation to each other and may rotate around each other.

Figure 6:
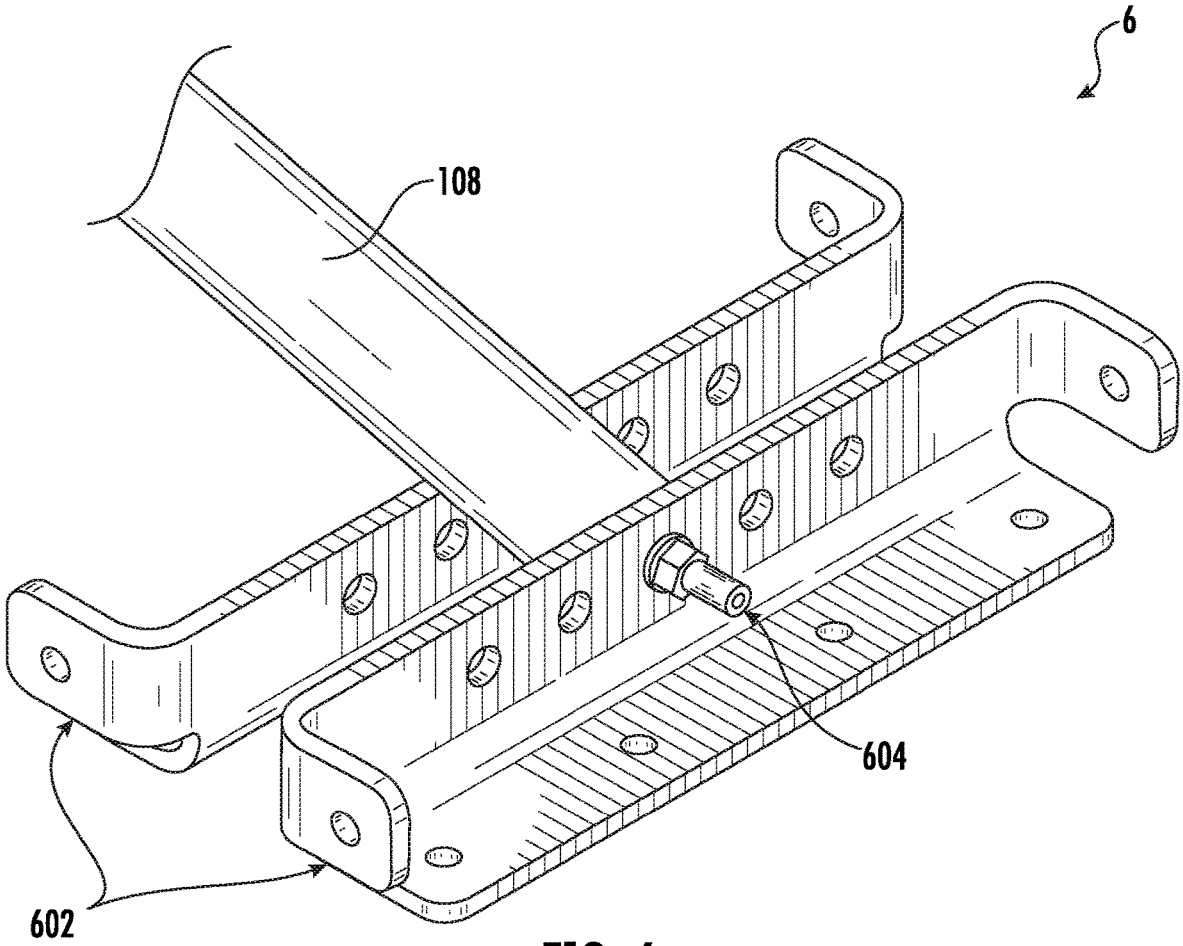
FIG. 6 is an enlarged view of a tieback bracket of the rooftop sector frame of FIG. 1.

Referring again to FIG. 1, the tieback pipes 108 may be anchored at a joint 6, which is shown enlarged in FIG. 6. The joint 6 generally contains a tieback bracket 602 into which a pin 604 inserts to provide a pivoting anchor for the tieback pipe 108. The pin 604 may be a fastener, such as a bolt, or a smooth shaft; the pin 604 may restrain the rotation of the tieback pipe 108 about the pivot point or may provide for free rotation.

Although the joints 2, 4, 5, and 6 are shown as corresponding to particular orientations and connections of particular pipes within the rooftop sector frame 100, it is contemplated that the joints 2, 4, 5, and 6 may be located in any position or orientation to connect any components of the rooftop sector frame 100. For example, the post brackets 110 may be replaced with a pin joint suitable to insert into a tieback bracket 602 to provide a quickly adjustable mount for the post 106.

In some embodiments, the joints 2, 4, 5, and 6 collectively permit a number of degrees of freedom in adjusting the configuration of the rooftop sector frame 100. Collectively, the joints permit rotational adjustment of the assembly of the antenna pipes 102 and the face pipes 104 (i.e., the antenna pipe array) in each of yaw, pitch, and roll as well as translational adjustment in each of transverse, longitudinal, and vertical directions. As used herein, "normal" generally refers to a direction normal to a plane substantially containing the underlying substrate on which the frame 100 is mounted; "transverse" generally refers to a direction perpendicular to the normal direction and generally corresponding to a side-to-side axis of the sector frame 100; and "longitudinal" generally refers to a direction perpendicular to both the normal direction and the transverse direction and generally corresponding to a front-to-back axis of the sector frame 100. "Vertical" generally refers to an upward direction not referenced to or dependent upon the orientation of the sector frame 100. Advantageously, the adjustable joints may permit the sector frame 100 to support an antenna pipe in a substantially vertical orientation, even if an axis normal to the underlying substrate is not vertical, such as even if the normal axis forms an included angle of greater than about 3 degrees with a vertical axis.

Figure 7:
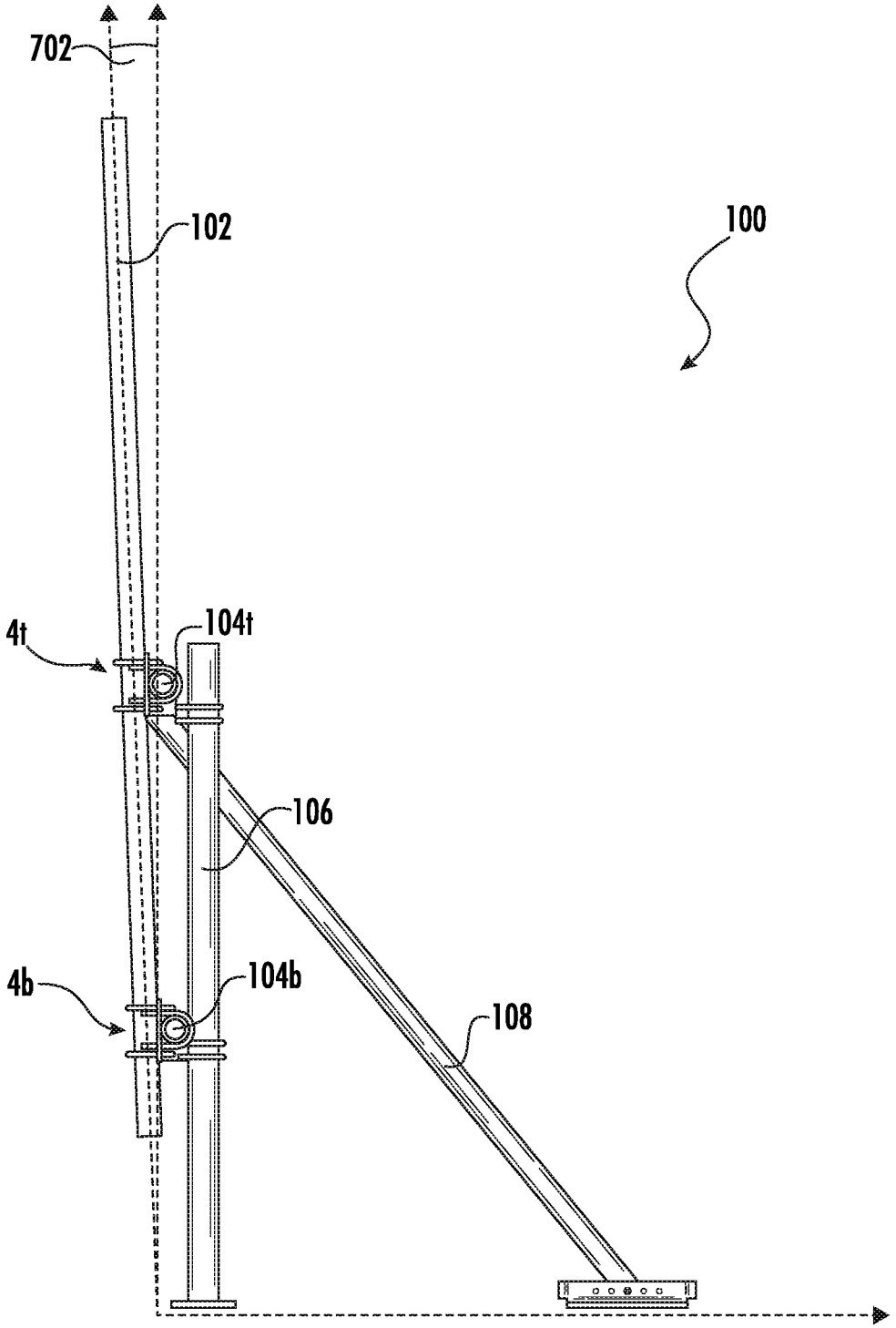
FIG. 7 is a side view of the rooftop sector frame of FIG. 1.

For instance, in one embodiment, pitch may be adjusted as shown in a side view of a rooftop sector frame 100 in FIG. 7. One or more antenna pipes 102 may be attached to one or more face pipes 104 to form an antenna pipe array tilted at a pitch angle 702. The pitch angle 702 of the antenna pipe array may be varied by spacing the top face pipe 104*t* at a first distance from the posts 106 in the top joint 4*t* and spacing the bottom face pipe 104*b* at a second distance from the posts 106 in the bottom joint 4*b*. The range of adjustability of the pitch angle 702 may be as broad as the geometry of the joints 4*t* and 4*b* allow (e.g., by the length of the elongated mounting slots 408). In some embodiments, the range of pitch angles 702 may include angles ranging from about 1 degree to about 10 degrees, such as about 5 degrees.

Figure 8:
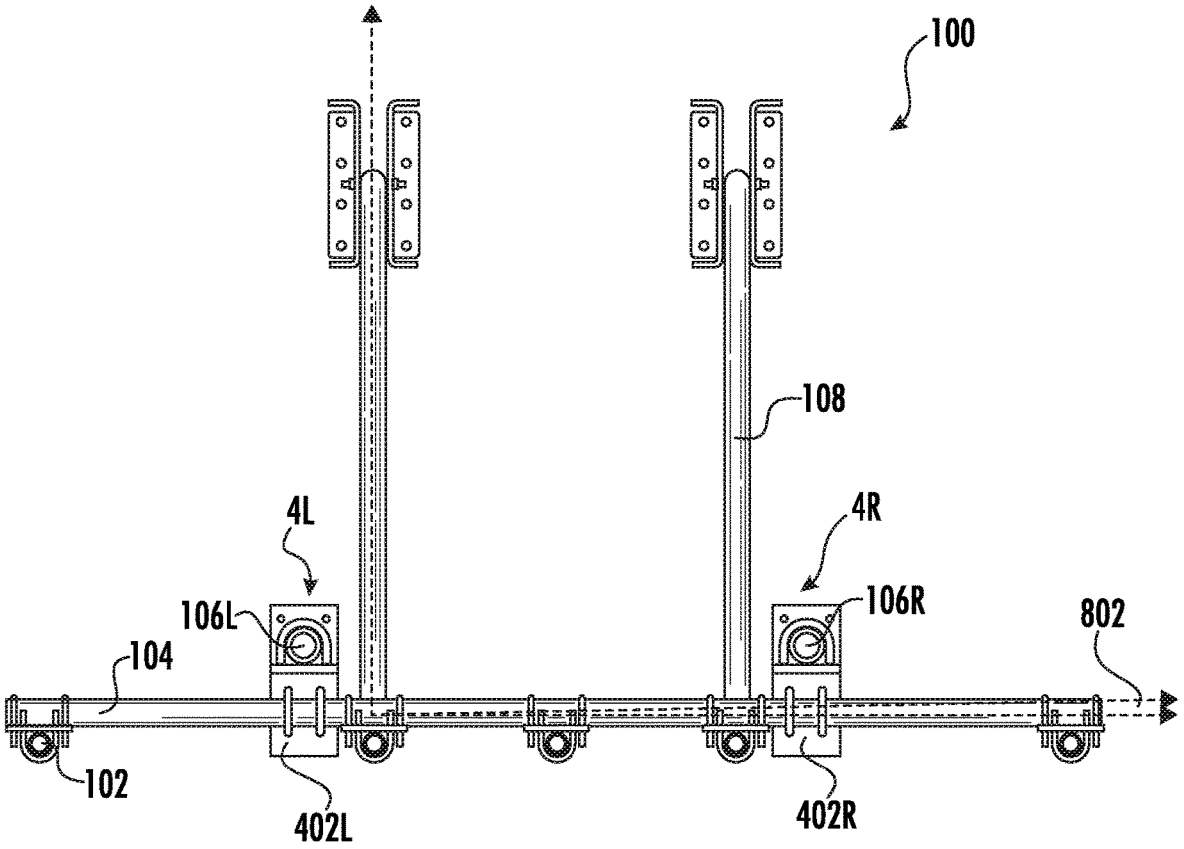
FIG. 8 is a top view of the rooftop sector frame of FIG. 1.

In one embodiment, yaw of the antenna pipe array may be adjusted as shown in a top view of a rooftop sector frame 100 in FIG. 8. The face pipes 104 are mounted on a left post 106L and a right post 106R via left joints 4L and right joints 4R, respectively. The left joint 4L has a left L-bracket 402L which holds the left end of a face pipe 104, and the right joint 4R has a right L-bracket 402R which holds the right end of a face pipe 104. The left L-bracket 402L holds the left end of the face pipe 104 a first distance away from the left post 106L while the right L-bracket 402R holds the right end of the face pipe 104 at a second distance away from the right post 106R, causing the face pipe 104 (and thus, the antenna pipe array) to rotate to a yaw angle 802 in the yaw direction. Advantageously, the antenna pipe array may rotate in yaw while remaining in a substantially planar arrangement (i.e., the posts 106L and 106R supporting the antenna pipe array do not skew with respect to each other). The range of adjustability of the yaw angle 802 may be as broad as the geometry of the joints 4L and 4R allows. In some embodiments, the range of yaw angles 802 may include angles ranging from about 1 degree to about 10 degrees, such as about 5 degrees.

Figure 9:
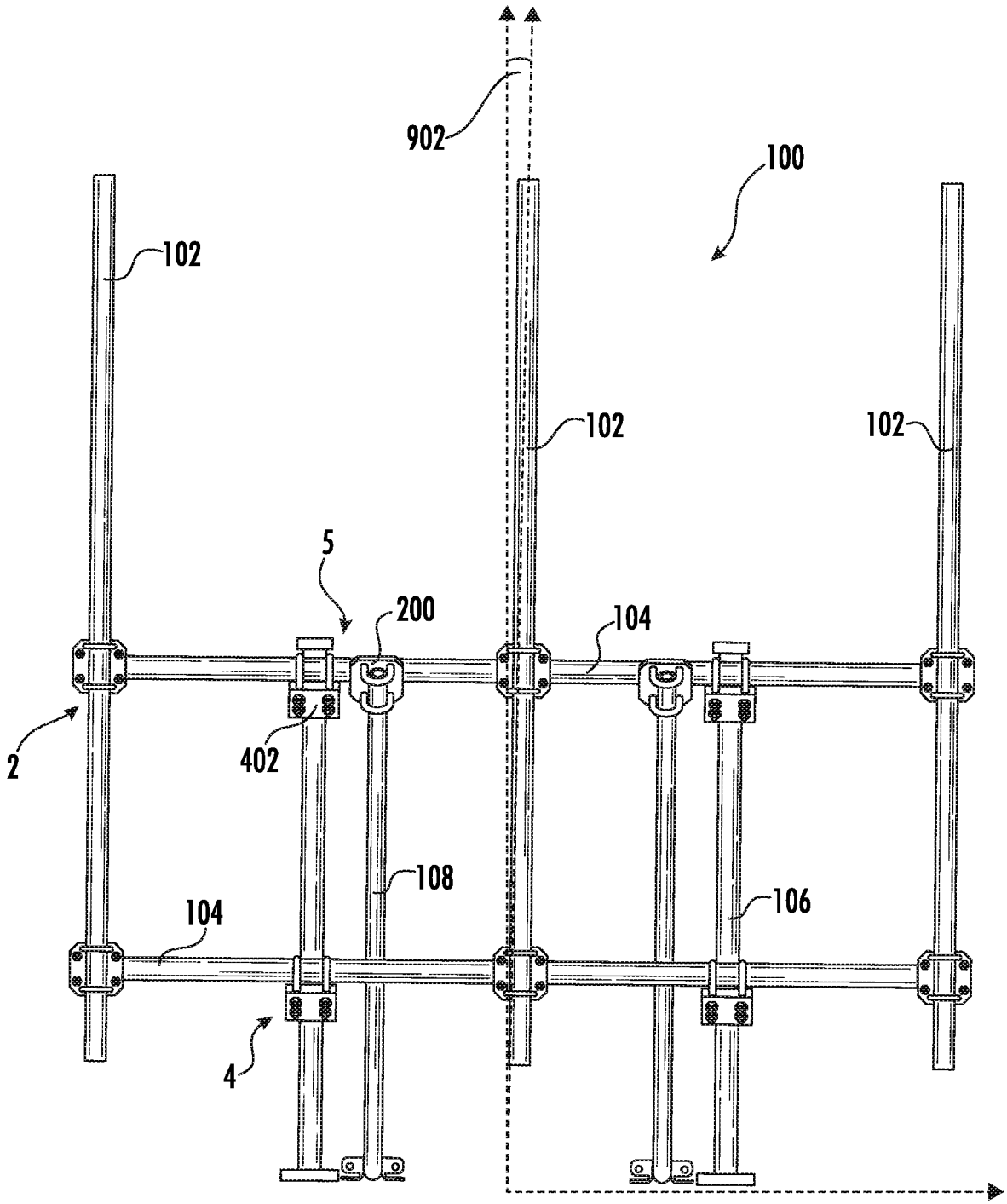
FIG. 9 is a front view of the rooftop sector frame of FIG. 1.

In one embodiment, roll of the antenna pipe array may be adjusted as shown in a front view of a rooftop sector frame 100 in FIG. 9. The face pipes 104 are mounted on posts 106 via joints 4 and 5, which each include L-brackets 402. Each of the L-brackets 402 may grip the posts 106 at an angle 902 by staggering the U-bolts 406 (as shown in FIGS. 4 and 5) in the same manner as the U-bolts 202' and 202" are staggered in FIG. 3, causing the assembly of the antenna pipes 102 and the face pipes 104 (i.e., the antenna pipe array) to roll at a roll angle 902. Advantageously, some embodiments of the joints 5 permit the L-brackets 402 on the posts 106 to be positioned independently of the crossover plates 200 on the tieback pipes 108, allowing the tieback pipes 108 to be angled with respect to the face pipe 104 using the crossover plate 200, which prevents the constraints on the tieback pipe 108 from limiting or eliminating the roll of the face pipe 104 relative to the posts 106. Alternatively, or additionally, a roll angle 902 may be achieved by individually tilting each antenna pipe 102 within each of its joints 2 (e.g., as shown in FIG. 3) without adjusting the entire face pipe 104. The range of adjustability of the roll angle 902 may be as broad as the geometry of the L-brackets 402 allow. In some embodiments, the range of roll angles 902 may include angles ranging from about 1 degree to about 10 degrees, such as about 5 degrees. In some embodiments, where the joints 2, 4, and 5 are all used to induce a roll angle, the range of achievable roll angles may increase up to double the range of adjustment provided by only joints 2 or joints 4 and 5.

Figure 10:
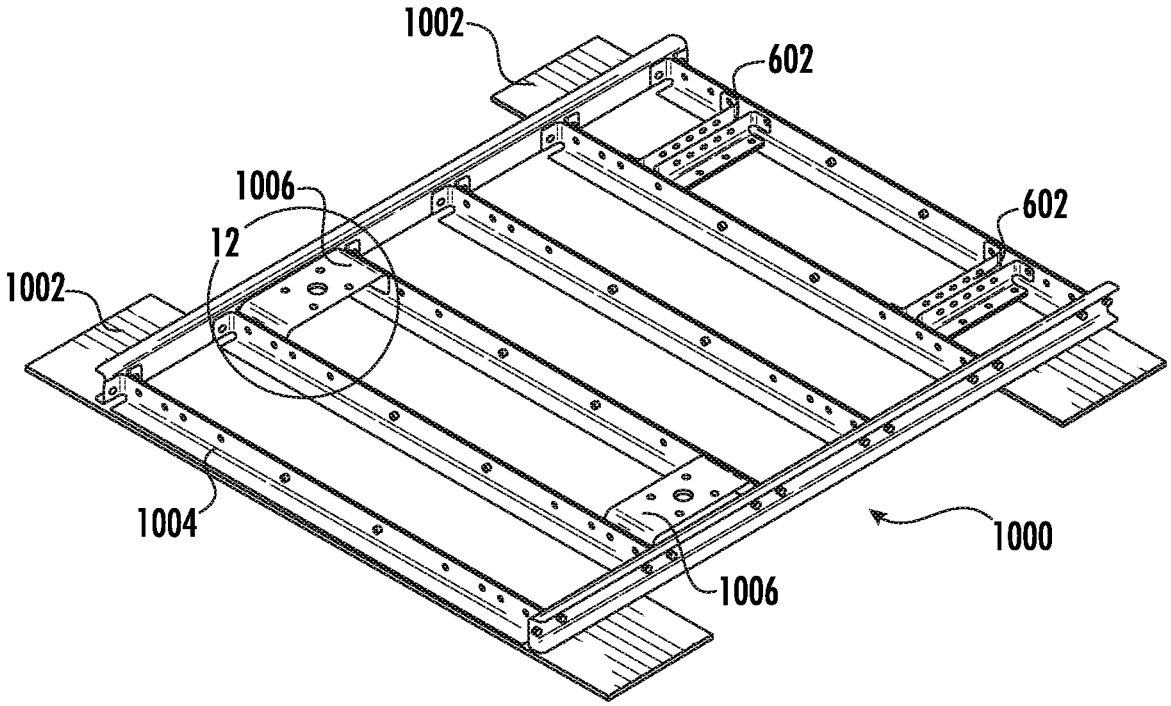
FIG. 10 is a front perspective view of one embodiment of a ballast sled of the present invention.
Figure 11:
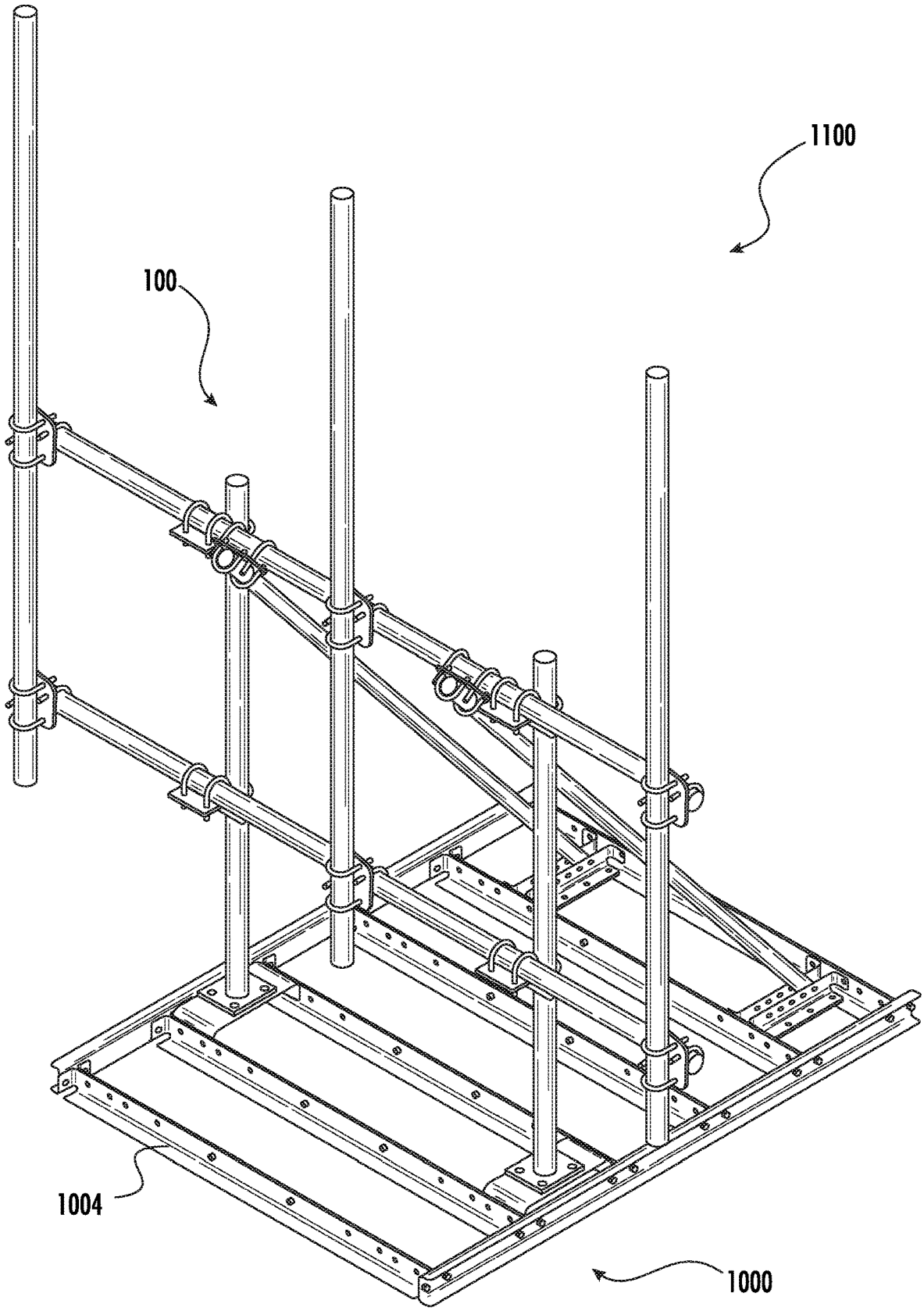
FIG. 11 is a front perspective view of an assembly of the rooftop sector frame of FIG. 1 attached to the ballast sled of FIG. 10.

The sector frame 100 may be anchored to an underlying substrate in any suitable manner. The substrate may be a rooftop, a platform, or any other structure, although the substrate may also be near to or directly on the ground. In some embodiments, the rooftop sector frame 100 is directly screwed, bolted, or otherwise attached directly to an underlying substrate through the post brackets 110 and/or the tieback brackets 602, such that the post brackets 110 and the tieback brackets 602 form a base of the sector frame 100 in contact with the substrate underneath. Alternatively, the rooftop sector frame 100 may be anchored first to a base such as the sled 1000 shown in FIG. 10, and the sled 1000 may then contact the substrate. The rooftop sector frame 100 may bolt to the sled 1000 to form the assembly 1100 shown in FIG. 11. The sled 1000 may, in turn, attach to an underlying structure, such as by welding, bolting, or otherwise anchoring crossbars 1004 to the structure. Alternatively, or additionally, the sled 1000 may include ballast trays 1002 (shown in FIG. 10) onto which ballast (e.g., concrete masonry units, or CMU) may be loaded. The ballast may be present in a sufficient quantity to stabilize the assembly 1100 against operational loads, including environmental loads (e.g., wind, rain, snow, flooding, etc.) and installation loads (e.g., handling, mounting of antennas, etc.), without penetrating or puncturing the underlying structure with bolts, screws, or other penetrating attachment features.

Figure 12:
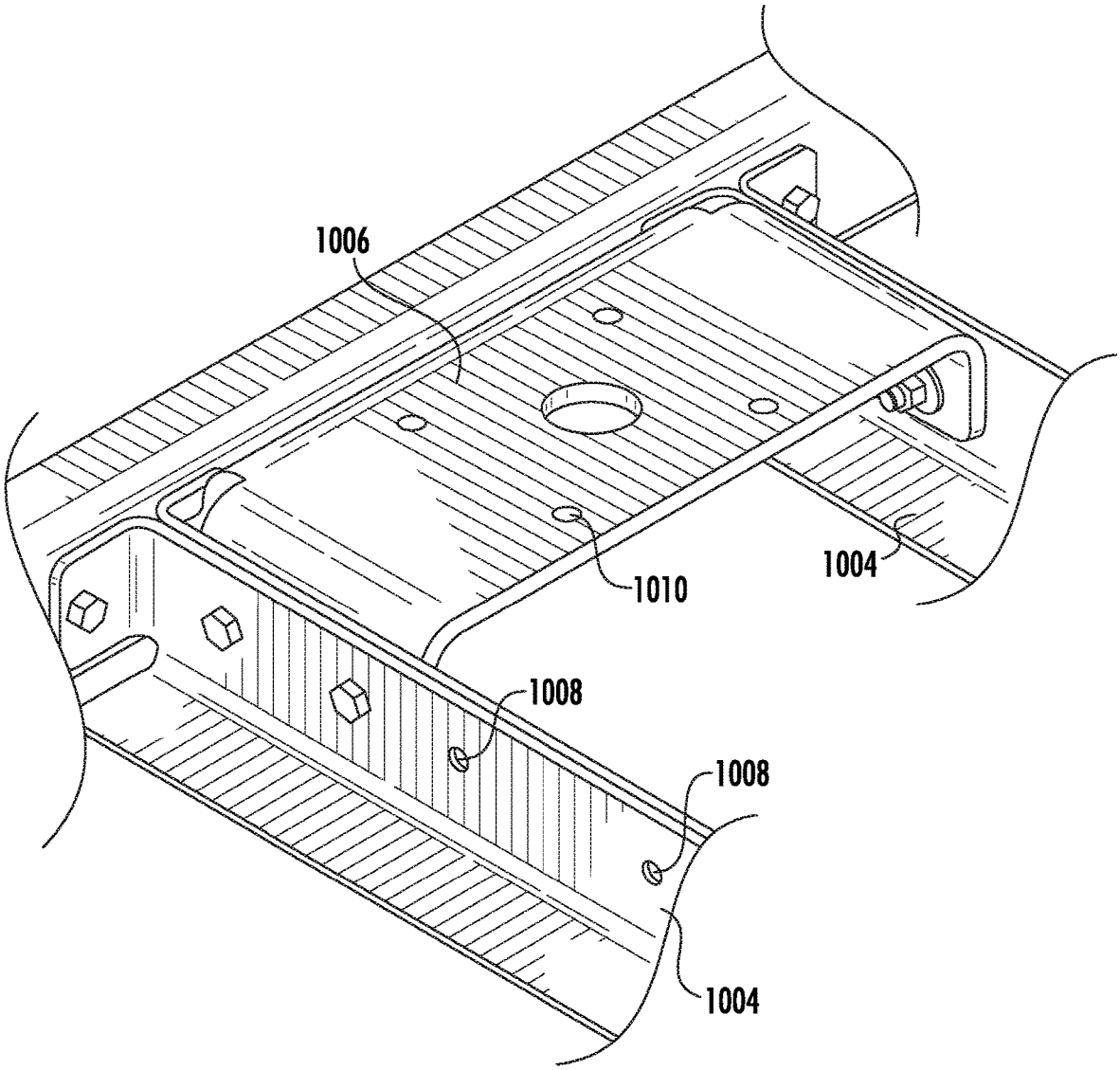
FIG. 12 is an enlarged view of a post bracket of the ballast sled of FIG. 10.

Referring again to FIG. 10, the sled 1000 may include a post receiver 1006 adapted to mate with a post bracket 110. The area 12 including the post receiver 1006 is shown enlarged in FIG. 12. The post receiver 1006 may include a bolt pattern 1010 for mating with a post bracket 110. The crossbars 1004 may optionally include a plurality of mounting holes 1008 to allow one or more post receivers 1006 to be installed simultaneously or to permit the location of the post receiver 1006 to be adjusted as needed. In general, the post receiver 1006 spans between two crossbars 1004. When installed between two crossbars 1004 adjacent to a ballast tray 1002, the post receiver 1006 may optionally define a hollow cavity with the ballast tray 1002 in order to minimize the intrusion into the usable ballast area of the ballast tray 1002.

Figure 13:
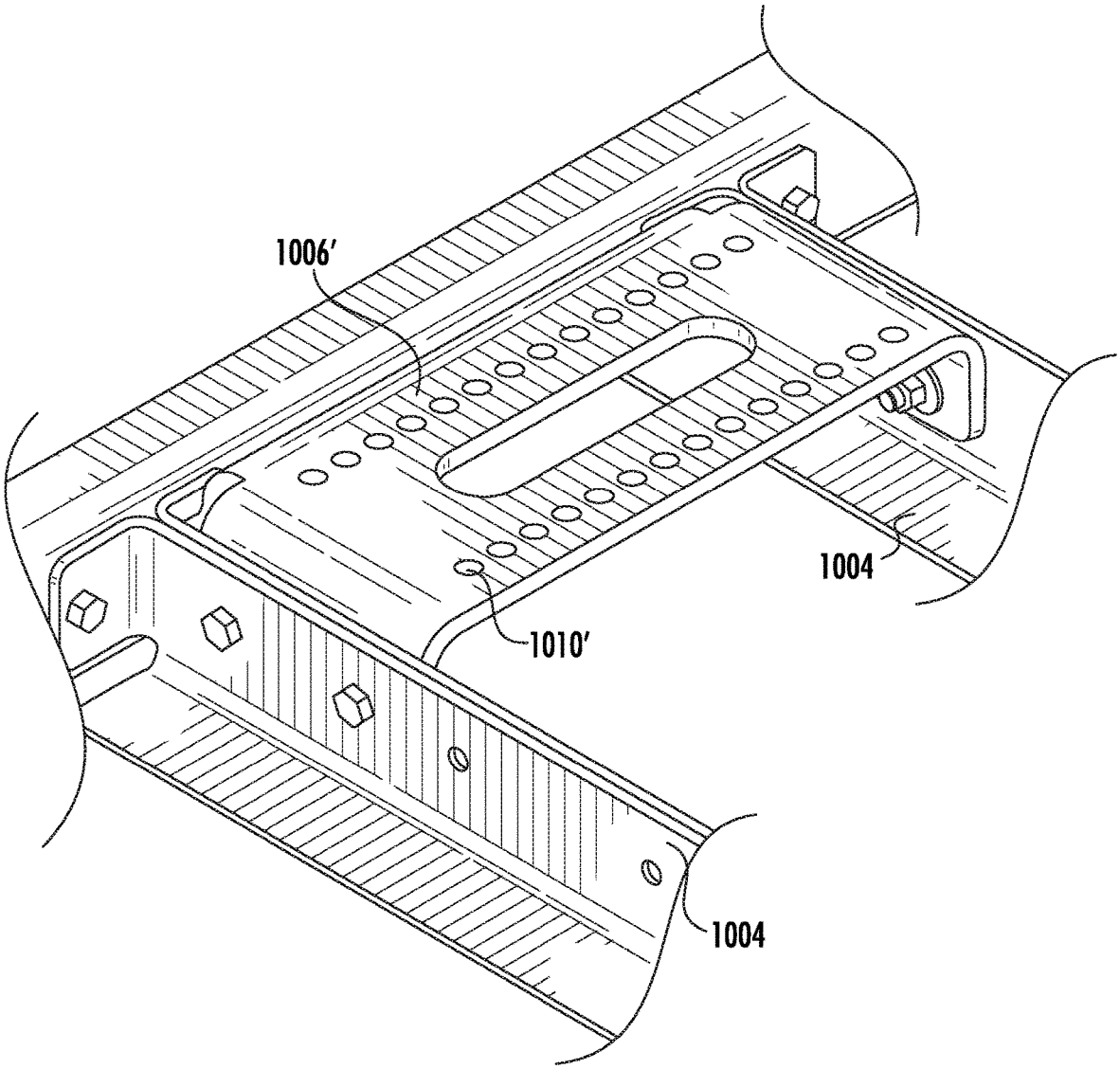
FIG. 13 is an enlarged view of an alternative embodiment of a post bracket of the ballast sled of FIG. 10.

As shown in FIG. 13, the bolt pattern 1010' may vary. In one embodiment, the bolt pattern 1010' provides numerous mounting locations. For instance, the post receiver 1006' may mate with a variety of different post brackets 110. Additionally, or alternatively, the post receiver 1010' may permit a post 106 with a post bracket 110 to be positioned in a variety of locations on the post receiver 1010', such as to induce a yaw angle. For example, referring again to FIG. 8, if the left post 106L were longitudinally spaced behind the right post 106R, yaw might be induced beyond that already achieved by manipulation of the L-brackets 402L and 402R, such as a yaw angle greater than about double that achievable by manipulation of the L-brackets 402L and 402R. A similar effect may also be achieved if at least one post 106 were mounted using a pin joint 604 with a tieback bracket 602—the pin joint 604 may permit quick rearrangement of the at least one post 106 to induce a desired yaw angle.

Figure 14:
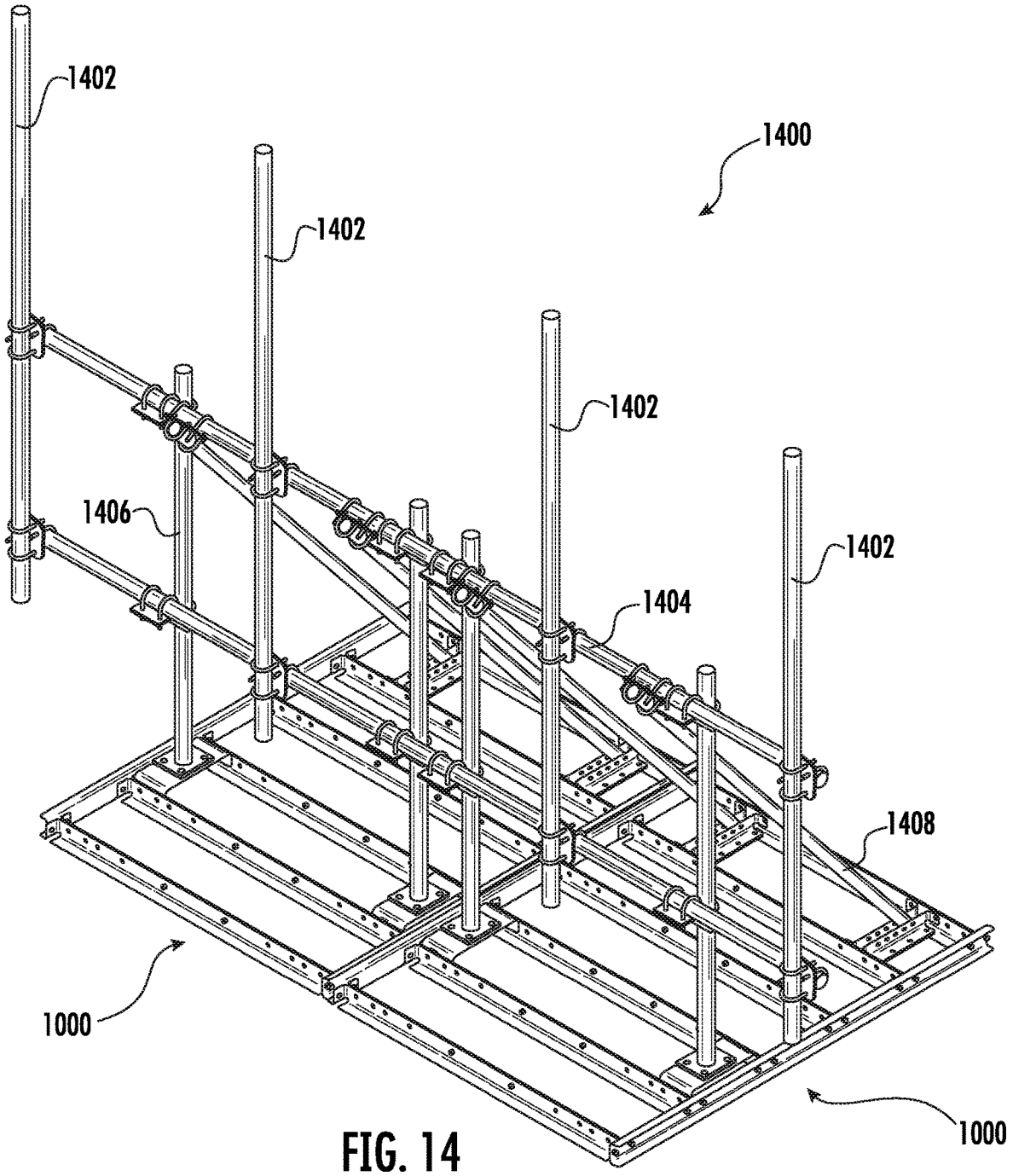
FIG. 14 is a front perspective view of one embodiment of a double rooftop sector frame attached to two ballast sleds of FIG. 10.
Figure 15:
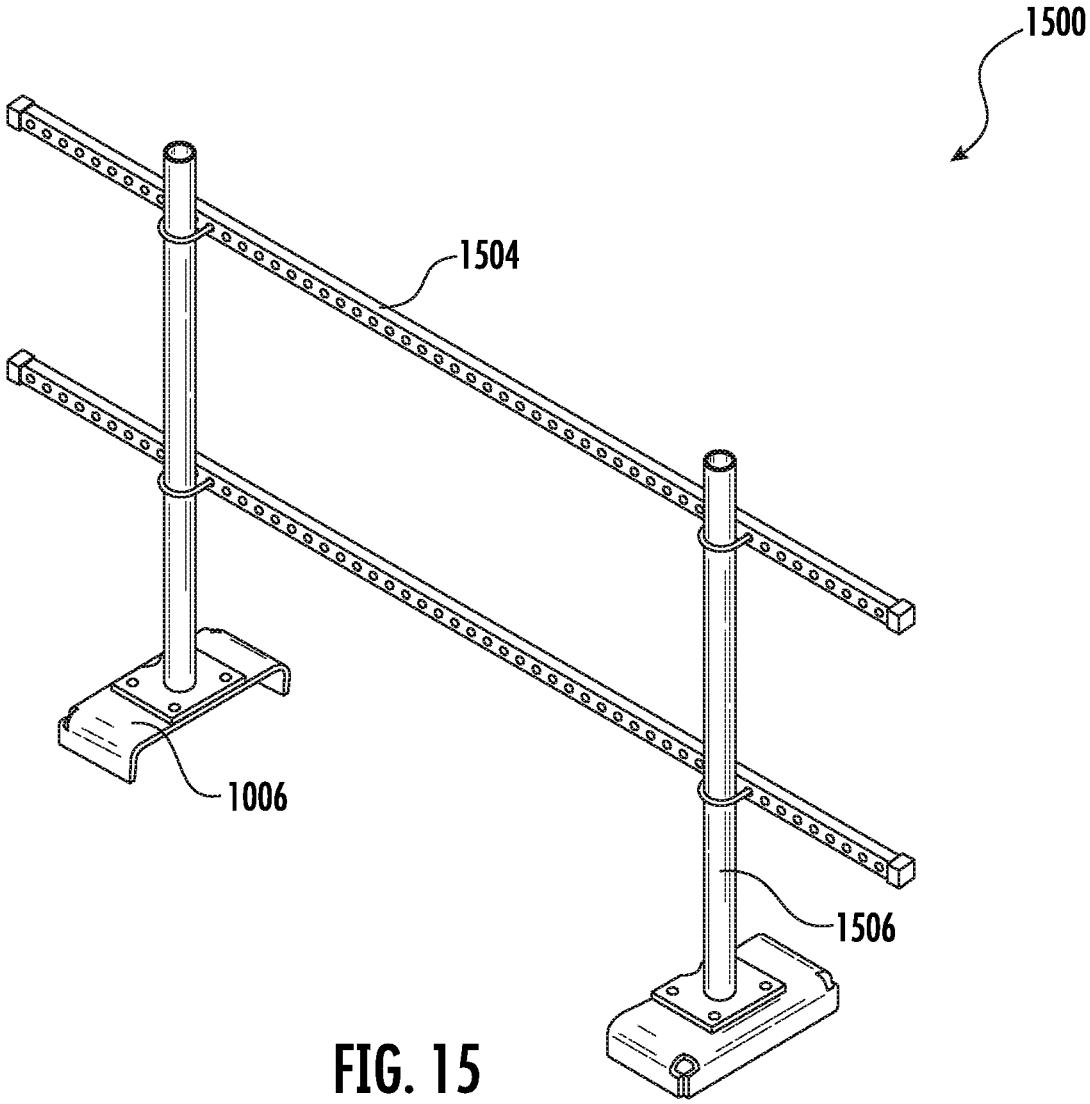
FIG. 15 is a front perspective view of an attachment.

The sled 1000 may be used alone or may be combined and/or attached to other similar or different sleds. Advantageously, the sleds may be modular. For example, a rooftop sector frame 1400 is pictured in FIG. 14. The frame 1400 includes face pipes 1404 which span the width of two sleds 1000. Each sled supports two posts 1406 and two tieback pipes 1408 to provide additional reinforcement to stabilize four antenna pipes 1402. In this manner, for example, an arrangement of modular sleds 1000 may provide an increased contact area for the base of the sector frame 1400.

Figure 16:
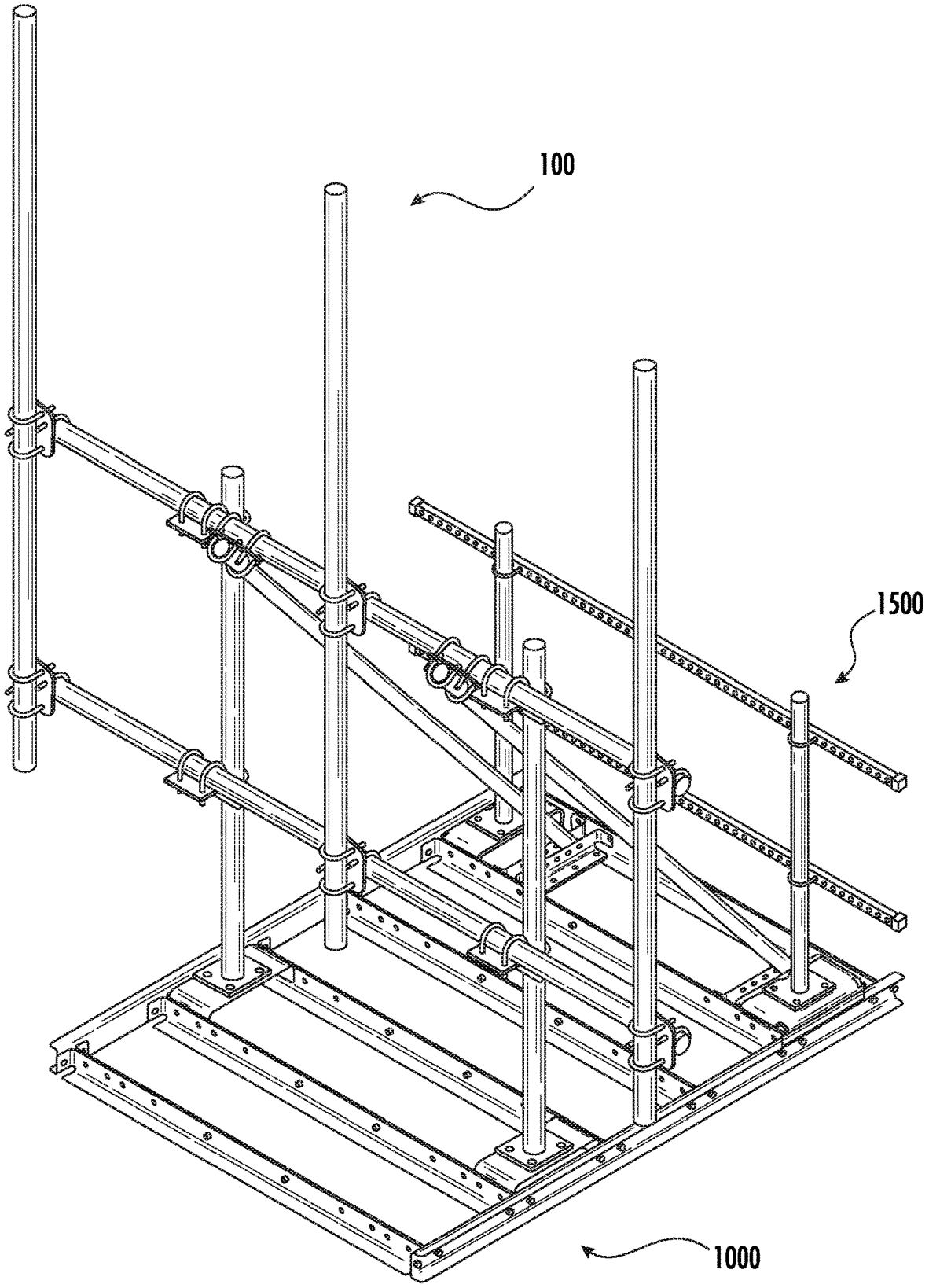
FIG. 16 is a front perspective view of an assembly of the attachment of FIG. 15 attached to the assembly of FIG. 11.
Figure 17:
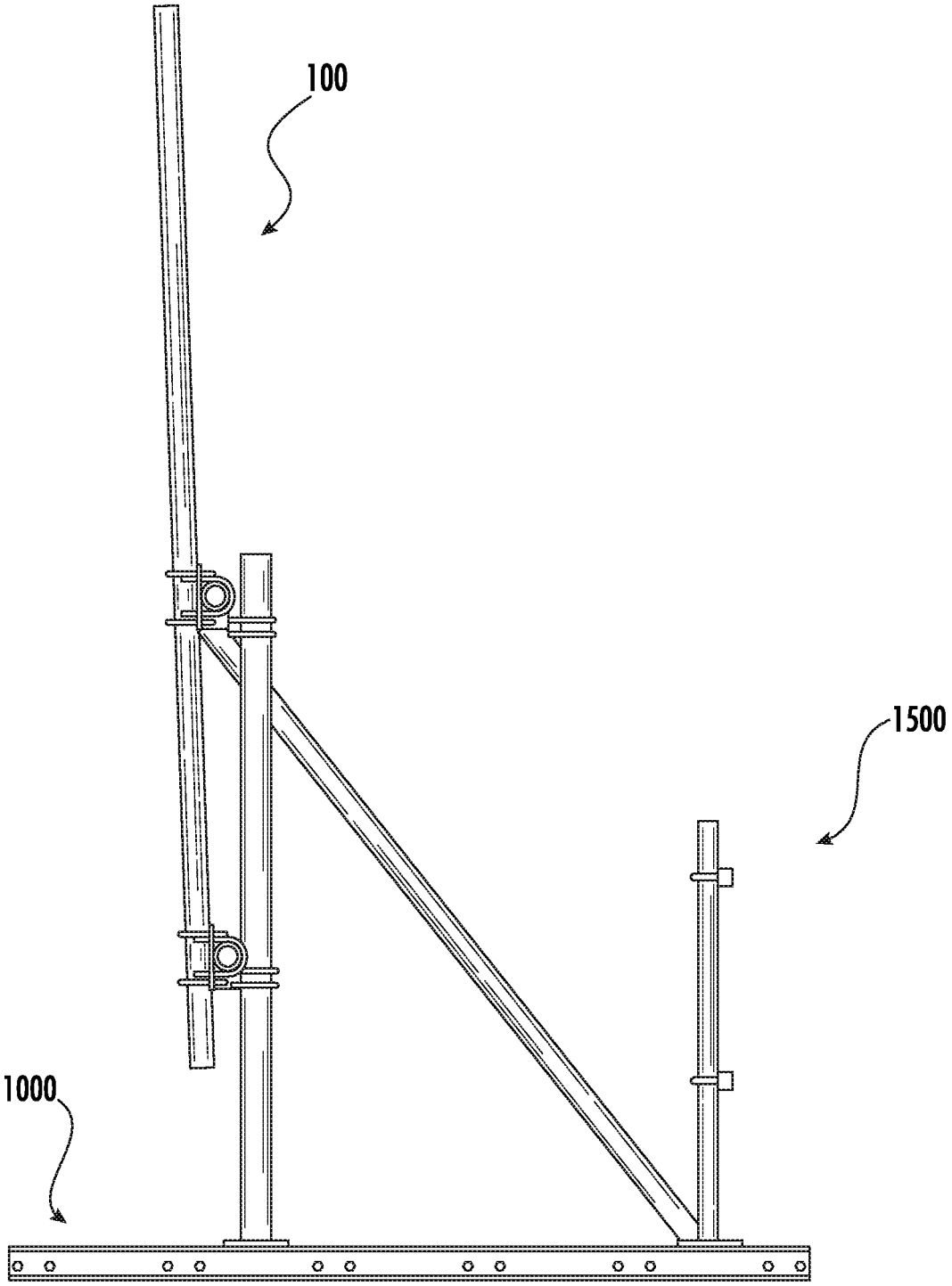
FIG. 17 is a side view of the assembly of FIG. 15.
Figure 18:
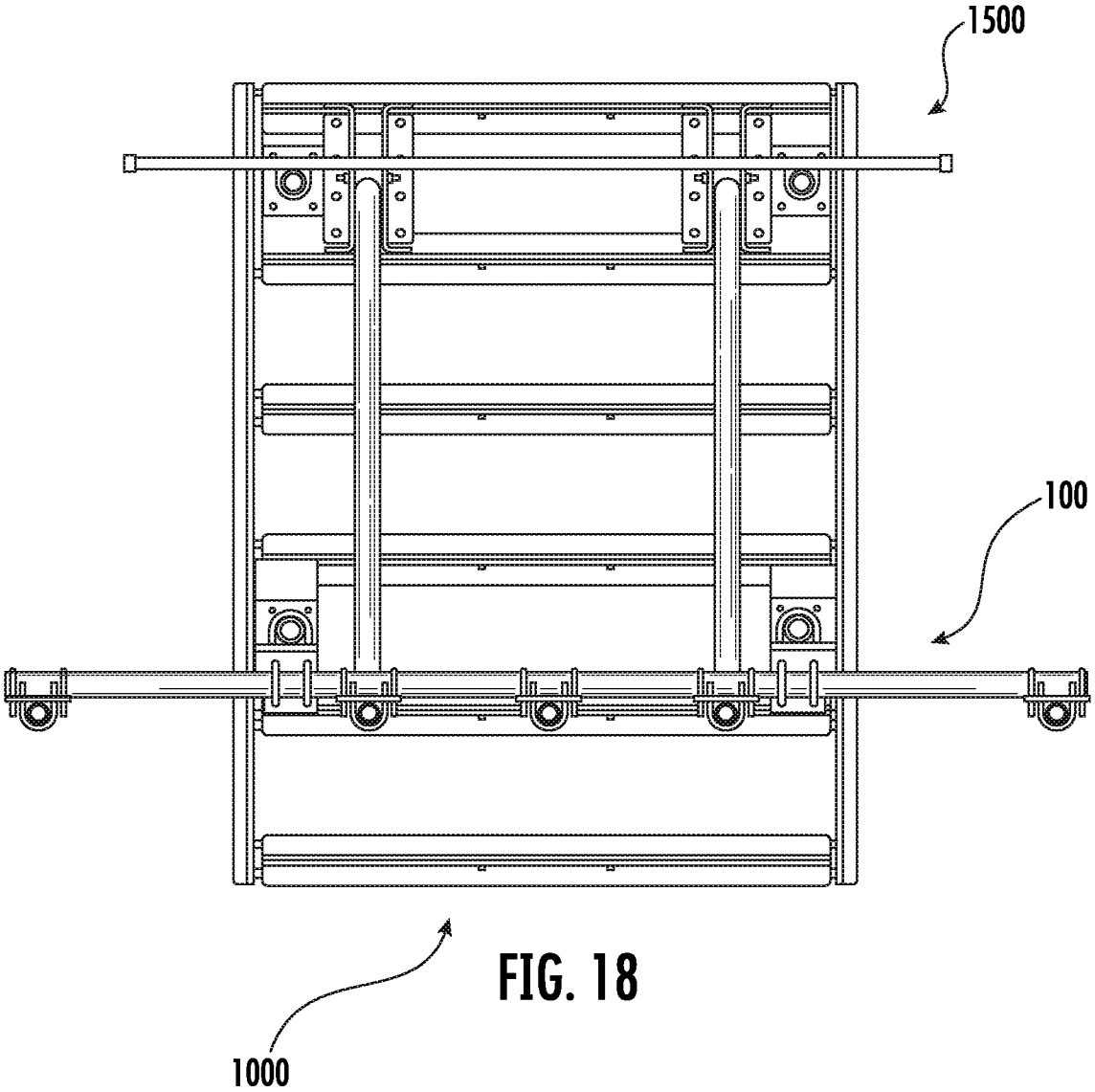
FIG. 18 is a top view of the assembly of FIG. 16.

Advantageously, the stability of the rooftop sector frame 100 may permit multiple attachments thereto. For instance, the attachment 1500 shown in FIGS. 15-18, formed from two crossbars 1504 and two posts 1506, may be attached to a sled 1000 via post receivers 1006, as shown in FIG. 16. The sled 1000 may anchor both the rooftop sector frame 100 and the attachment 1500. In some embodiments, the attachment may be used as a second mount area for electronic equipment. In some embodiments, the attachment may be used as a handrail. The stability and strength of the rooftop sector frame 100 permits the sled 1000 to be subjected to extra loading (e.g., from the weight of additional equipment or a person leaning on or grasping the handrail) without harmfully disturbing the electronics mounted thereon.

In some embodiments, the rooftop sector frame 100 may comprise removable footprint extensions. Footprint extensions may be formed from structural members similar or different from the structural members within the sector frame 100 or the ballast sled 1000. Advantageously, footprint extensions may decrease the live load pressure on the roof underneath and/or increase the amount of ballast which may be used, either placed in the ballast sled 1000 or directly into the extensions (e.g., via ballast trays 1002 attached thereto). For instance, one or more of the footprint extensions may permit the assembly to remain under the International Building Code 40 pounds per square foot ultimate and 20 pounds per square foot allowable pressure thresholds.

In some embodiments, the footprint extensions may increase and/or redistribute the area over which the assembly weight and operational loads are distributed. For example, one or more ballast trays 1002 may be attached to one or more footprint extensions to increase the total amount of ballast used and/or to redistribute the ballast employed to adjust the pressure applied to the roof underneath. In some embodiments, the base (e.g., a ballast sled 1000) of the sector frame 100 (with or without any extensions) contacts the underlying substrate along a first contact surface. The first contact surface may generally distribute any loads experienced by the sector frame 100, including static weight loads (e.g., the combined weight of the frame 100, a base, equipment mounted to the frame 100, and/or any extensions), environmental loads (e.g., wind, snow, etc.), and other operational loads (e.g., handling and manipulation of equipment mounted on the frame 100, interaction with and climbing/walking on the frame 100, etc.). The total load(s) divided by the first contact area may provide a first mean contact pressure over the first contact area. The addition and attachment of an extension to the base (e.g., a ballast sled 1000) which also contacts the underlying substrate may provide additional contact area with the substrate, increasing the total contact area between the sector frame 100 assembly and the substrate to a combined second contact area, providing for a second distribution of the load(s) experienced by the sector frame 100. In some embodiments, a second mean contact pressure over the second contact area may be less than the first mean contact pressure. In some embodiments, the attachment of an extension may also lower a peak or maximum local pressure exerted onto the substrate at any point along the base of the sector frame.

In some embodiments, additional ballast may be located near the front and/or the rear of the sled 1000, which may increase the resistance of the frame 100 to wind loads (e.g., increasing resistance to deflection and/or overturn). Advantageously, even if no additional ballast is required, an extension may be attached to a side of the frame 100 substantially opposite to a direction from which the majority of wind loading is experienced. For instance, the addition of an extension to resist wind loads may, in some embodiments, reduce the ballast loading requirement, thereby reducing the pressure exerted on the underlying substrate (i.e., the rooftop). In some embodiments, an extension may be attached on a side of the frame 100 substantially opposite a direction in which the Effective Projected Area (EPA) is higher than in another direction, such as a direction in which the EPA is at a maximum (e.g., a local maximum or a global maximum). In some embodiments, an extension may be added opposite a direction normal to the antenna pipe array of the sector frame 100.

Figure 19:
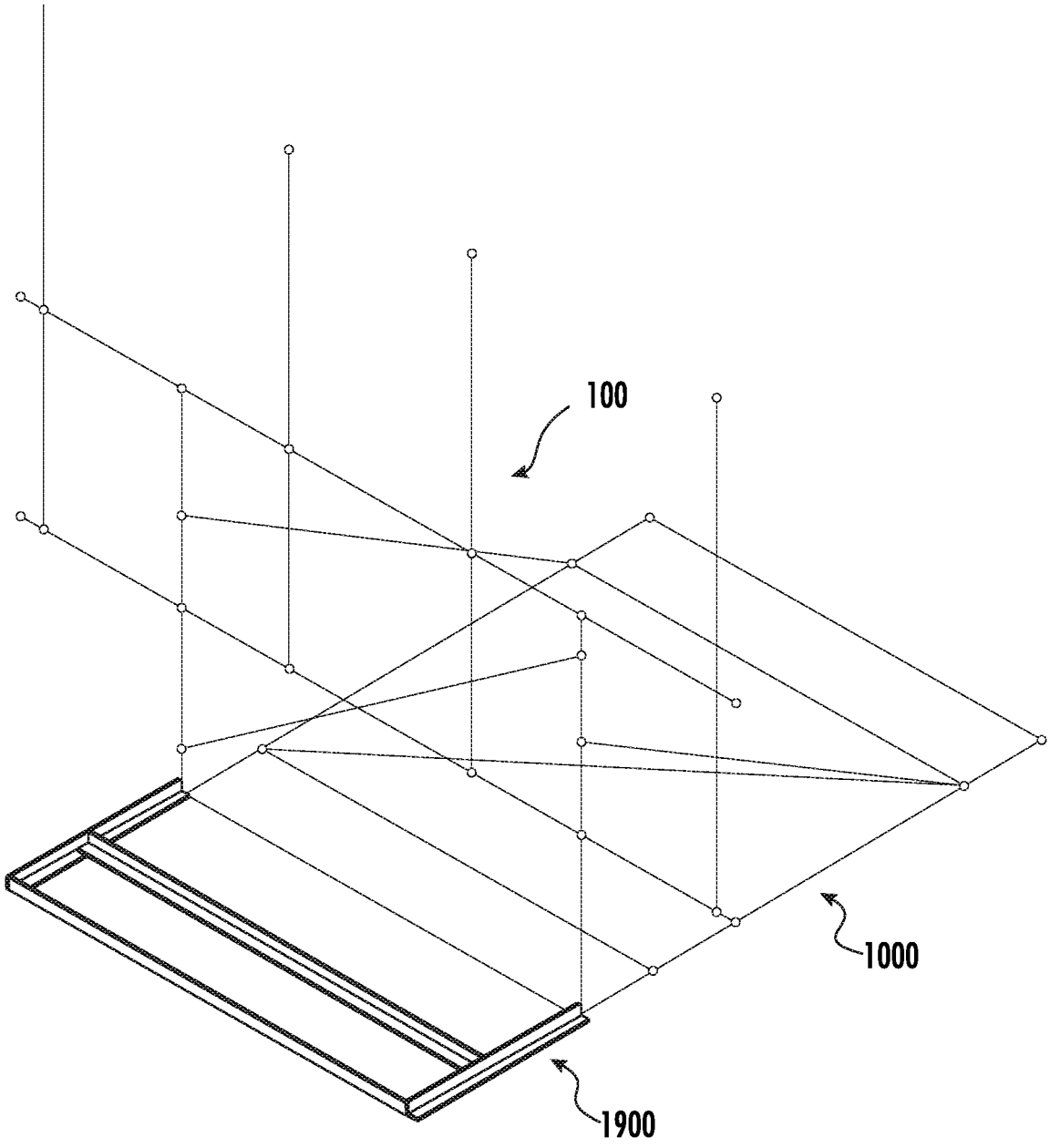
FIG. 19 is a front perspective view of a diagram of the assembly of FIG. 11 attached to a front footprint extension.
Figure 20:
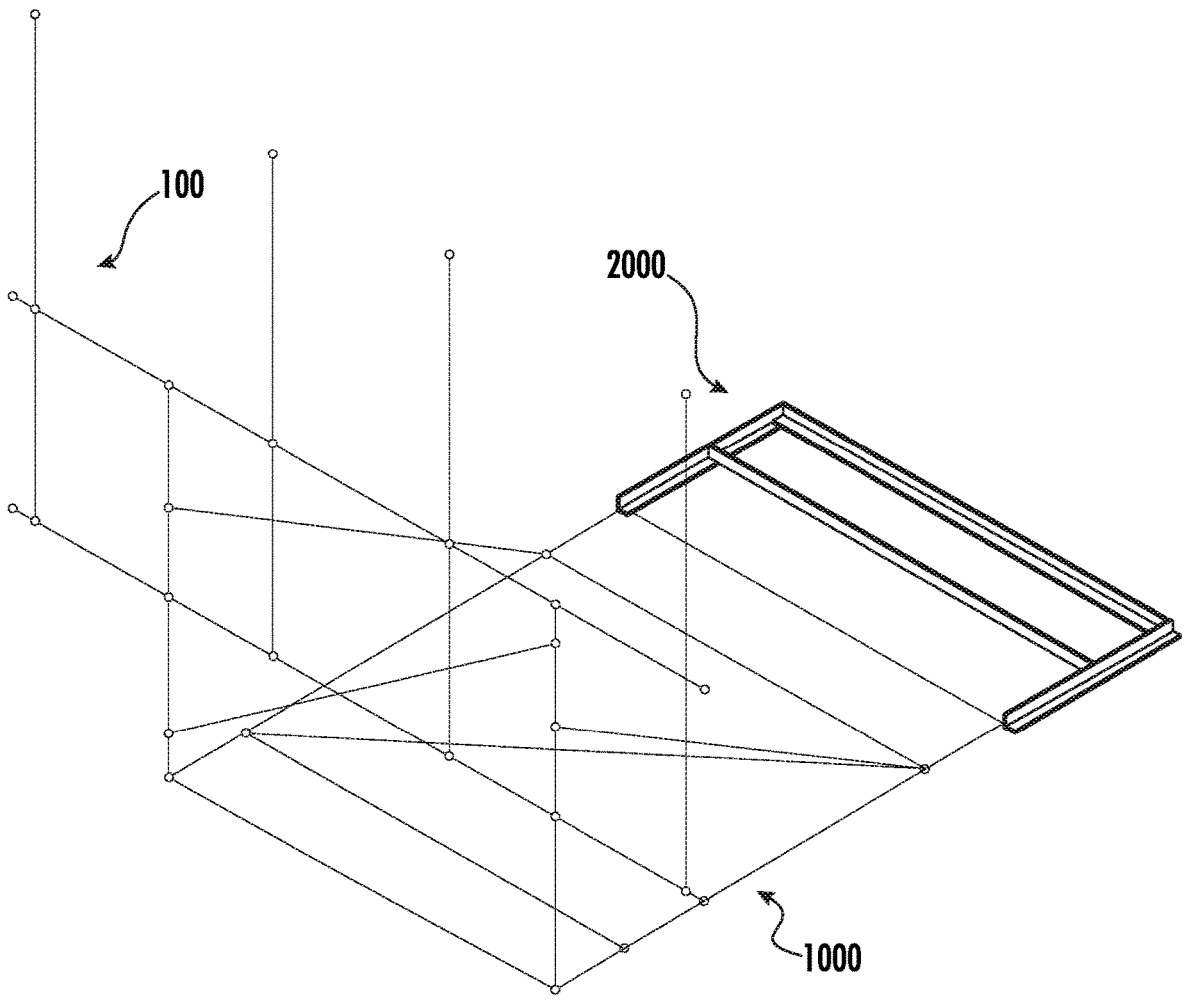
FIG. 20 is a front perspective view of a diagram of the assembly of FIG. 11 attached to a rear footprint extension.
Figure 21:
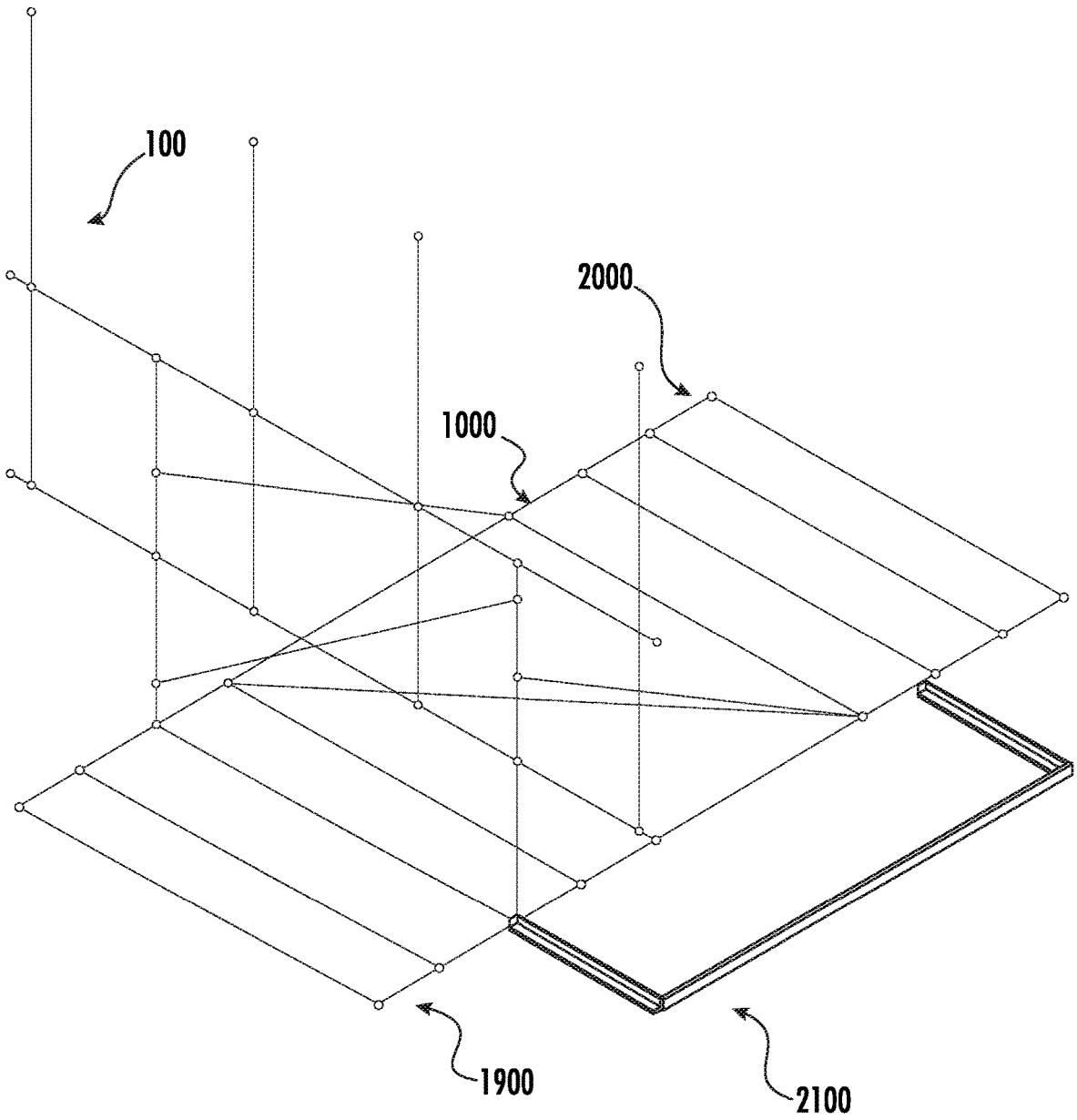
FIG. 21 is a front perspective view of a diagram of the assembly of FIG. 11 attached to a side footprint extension.
Figure 22:
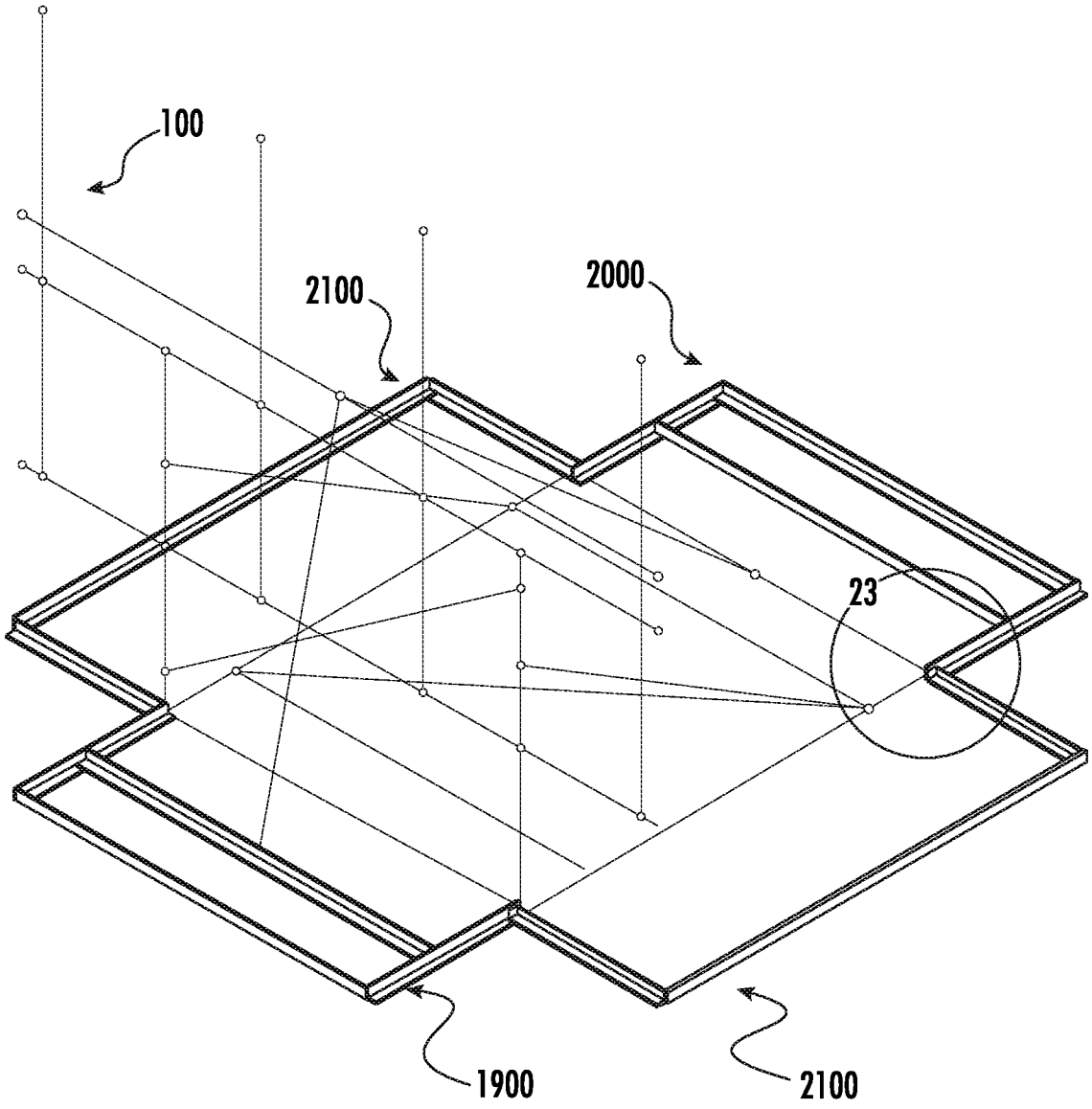
FIG. 22 is a front perspective view of a diagram of the assembly of FIG. 11 attached to footprint extensions on the front, rear, and both sides.
Figure 23:
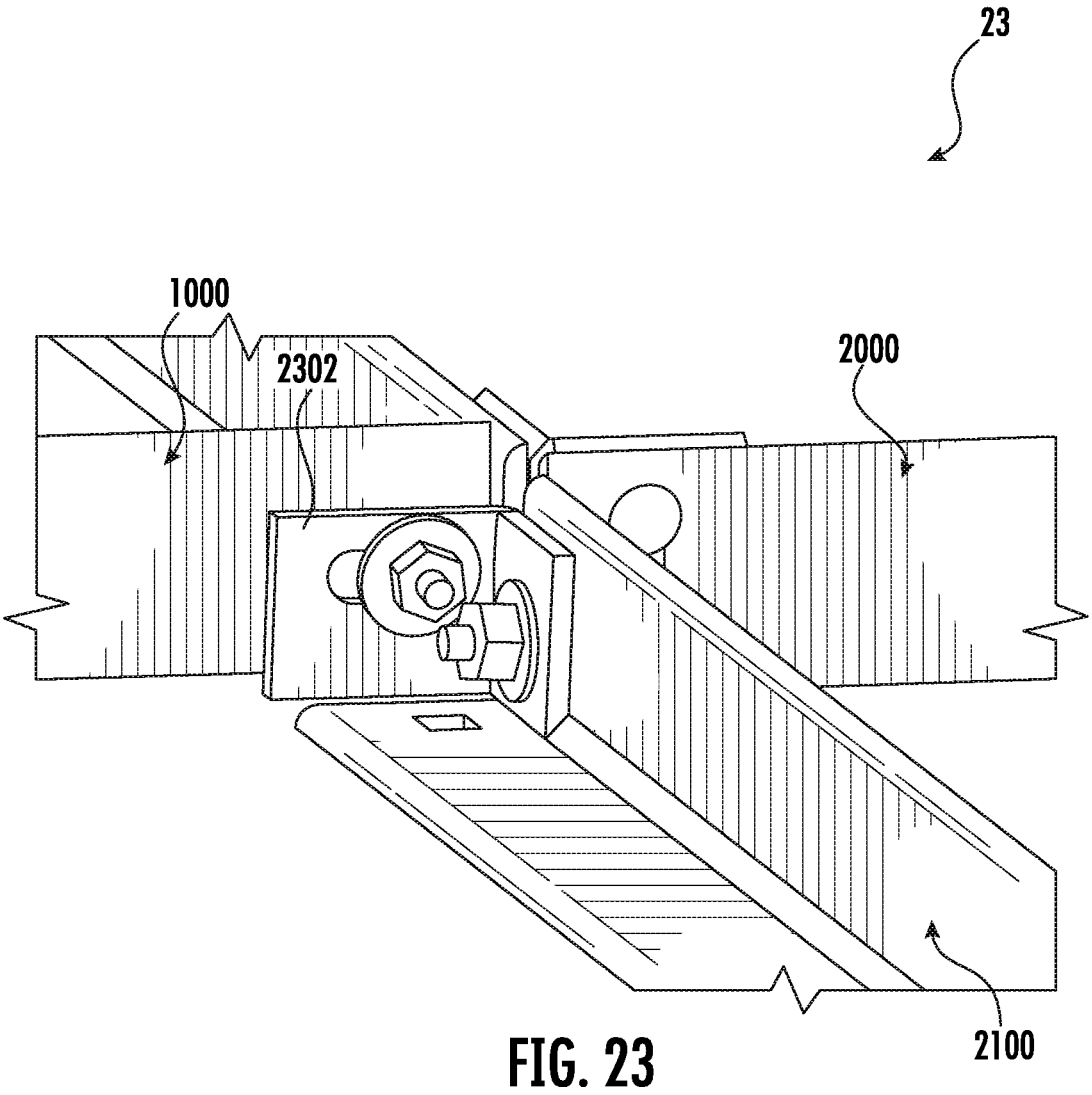
FIG. 23 is an enlarged view of a junction between the rear footprint extension, side footprint extension, and sled of FIG. 22.

In one embodiment shown in FIG. 19, a front footprint extension 1900 may be attached to the front of the sled 1000 of the frame 100. As shown in FIG. 20, a rear footprint extension 2000 may be attached to the rear of the sled 1000 of the frame 100. As shown in FIG. 21, a side footprint extension 2100 may be attached to the side of the sled 1000 of the frame 100. Any or all of the front extension 1900, rear extension 2000, and side extension 2100 may be used alone or in conjunction with each other. Advantageously, the independently configurable footprint extensions may permit the frame 100 to be situated near walls and/or in corners while meeting the live load pressure threshold requirements. In some embodiments, all the extensions are used simultaneously, as shown in FIG. 22. The footprint extensions may be attached via clip angles 2302 in a joint 23 as shown in FIGS. 22-23.

Advantageously, the clip angles 2302 may permit sleds 1000 to be retrofit with footprint extensions 1900, 2000, and/or 2100 after installation of the sled 1000. For instance, a sector frame 100 on a sled 1000 may have equipment already installed thereon, and at least one extension may be added to improve the load distribution. Additionally, or alternatively, a sector frame 100 on a sled 1000 may have electronic equipment already installed thereon, and at least one extension may be added to improve the load distribution in preparation for or in coordination with the installation of additional or different electronic equipment. In some embodiments, the extensions attach with a quick-release mechanism. Alternatively, or additionally, the extensions may attach to the sled 1000 with a low component count attachment mechanism, such as with a clip angle 2302 and one, two, or three bolts.

Figure 24:
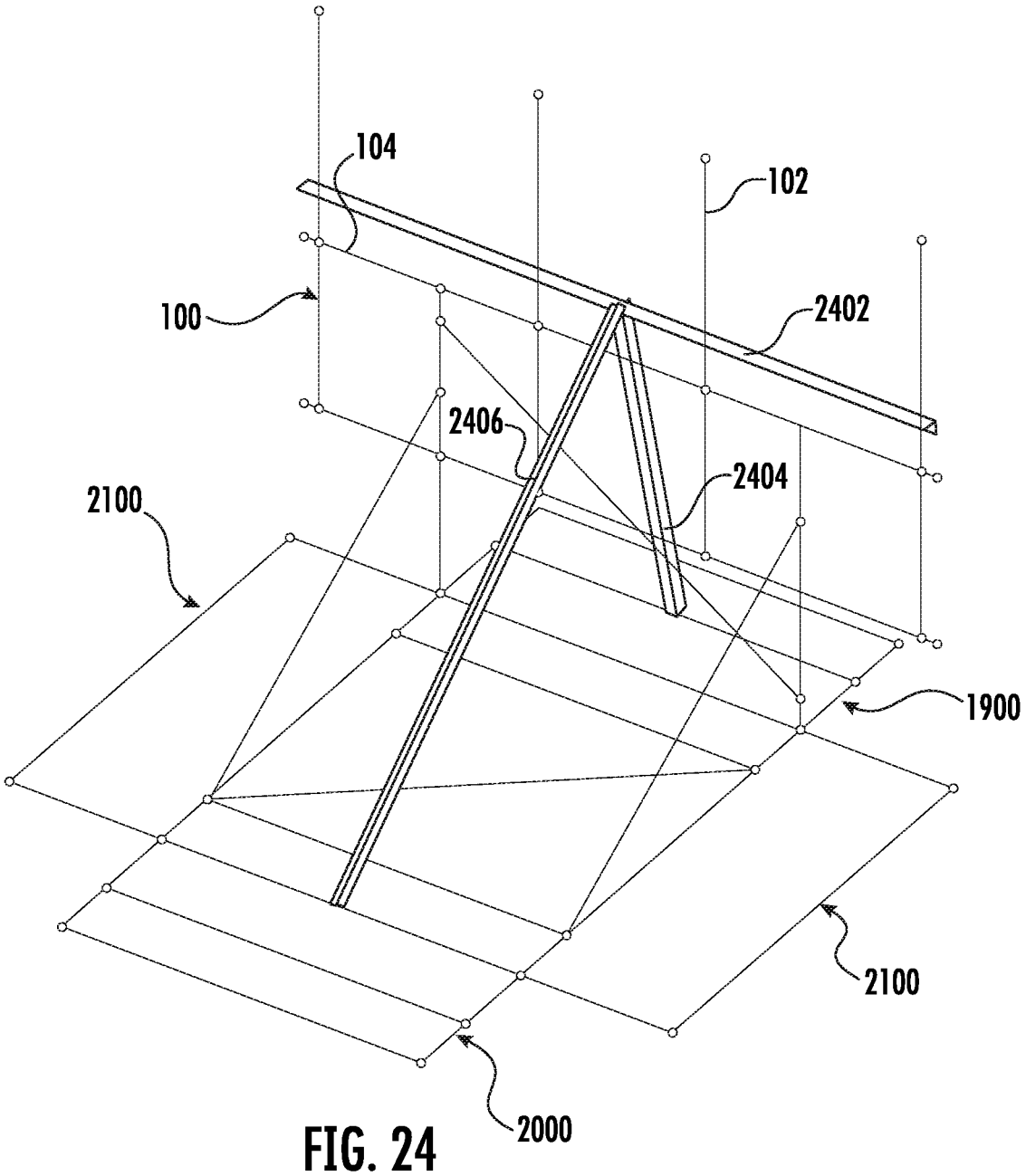
FIG. 24 is a rear perspective view of a diagram of the assembly of FIG. 11 attached to footprint extensions on the front, rear, and both sides, with front and rear diagonal reinforcements added to support the antenna pipes.
Figure 25:
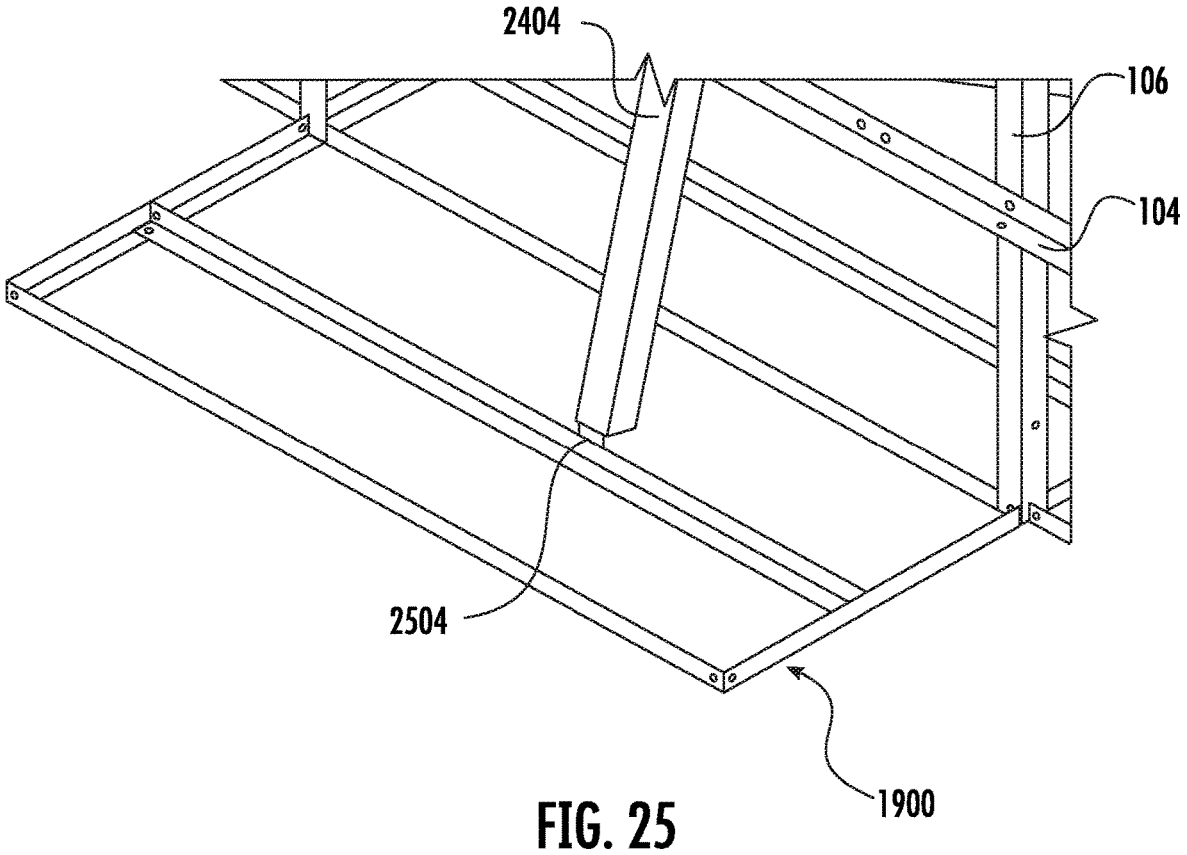
FIG. 25 is a front partial perspective view of the lower attachment point of the front diagonal reinforcement of one embodiment of a rooftop sector frame.
Figure 26:
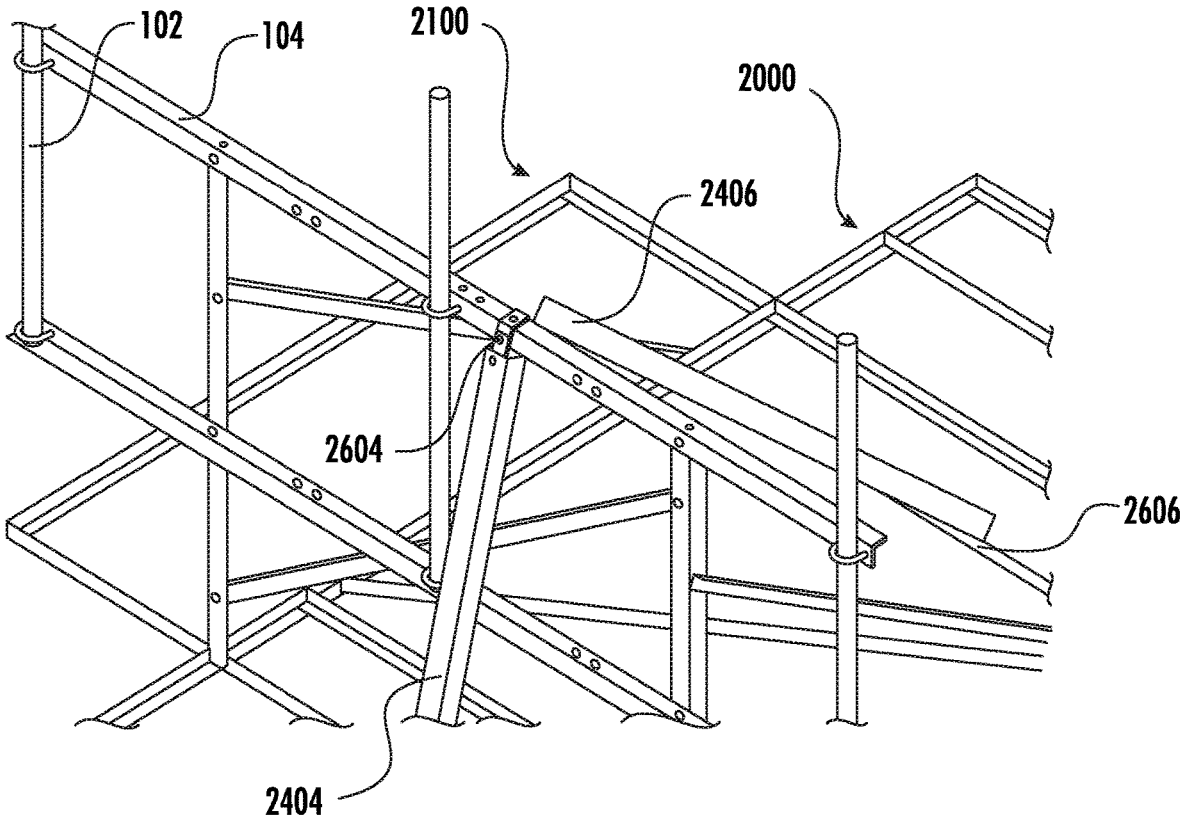
FIG. 26 is a front partial perspective view including the lower attachment point of the rear diagonal reinforcement of one embodiment of a rooftop sector frame.

In some embodiments, the rooftop sector frame 100 may comprise diagonal reinforcements to the antenna pipes 102 and/or the face pipes 104, as shown in FIG. 24. For instance, a face support 2302 may attach to the antenna pipes 102, the face pipes 104, or both, with, for example, a joint type corresponding to a joint 2, 4, or 5 shown in FIG. 1. The front diagonal 2404, the rear diagonal 2406, or both may attach to the face support 2402 with, for example, a joint type corresponding to a joint 5 as shown in FIG. 5. The front diagonal 2404, the rear diagonal 2406, or both may attach to the sled 1000 and/or any of the footprint extensions 1900, 2000, and/or 2100 with, for example, a joint type corresponding to a joint 6 or the post brackets 110 of FIG. 1. Alternatively, clip angles 2504 and 2606 may secure the front diagonal 2404 (as in FIG. 25) and/or the rear diagonal 2406 (as in FIG. 26), respectively. A clip angle 2604 may also join either or both of the front diagonal support 2404 and the rear diagonal support 2406 to a face support 2402 (as in FIG. 24), or a face pipe 104 (as in FIG. 26).

The foregoing is illustrative of the present invention and is not to be construed as limiting thereof. Although exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A sector frame, comprising a plurality of structural members, the plurality of structural members including one or more adjustable structural members, an antenna pipe for the mounting of electronic equipment, and a face pipe along which the antenna pipe is disposed, the antenna pipe and the face pipe forming an antenna pipe array;

a plurality of adjustable joints disposed between the one or more adjustable structural members and the antenna pipe array; and a base forming a base contact surface with a planar substrate, wherein the one or more adjustable structural members includes a first post and a second post, each post extending upwardly and generally perpendicularly from the base and attaching to the face pipe of the antenna pipe array with one or more of the adjustable joints, and wherein the adjustable joints of the sector frame are operable to provide rotation of the antenna pipe array in at least two directions selected from:

rotation about a normal axis, the normal axis being normal to the substrate;

rotation about a transverse axis perpendicular to the normal axis; and rotation about a longitudinal axis perpendicular to both the normal axis and the transverse axis.

2. The sector frame of claim 1, wherein the antenna pipe array is operable to rotate up to about 10 degrees in each of the at least two directions.

3. The sector frame of claim 1, wherein the antenna pipe array is configured to remain substantially planar throughout the rotation in the at least two directions.

4. The sector frame of claim 1, wherein the face pipe of the antenna pipe array is attached to the first post with a first adjustable post joint;

wherein the face pipe of the antenna pipe array is attached to the second post with a second adjustable post joint; and wherein the first adjustable post joint and the second adjustable post joint are operable to rotate the antenna pipe array about the normal axis, the transverse axis, and the longitudinal axis.

5. The sector frame of claim 1, wherein each adjustable joint of the sector frame comprises a connection with a first structural member and a second structural member; and fasteners disposed along a repositionable structural member selected from the first structural member and the second structural member;

wherein a first fastener is repositionable to a first position and a second position;

wherein a second fastener is repositionable to a third position and a fourth position; and wherein the repositionable structural member experiences a rotation or a translation corresponding to a selection of the positions of the first fastener and the second fastener.

6. The sector frame of claim 1, wherein the adjustable joint of the sector frame corresponds to the connection between two structural members of the sector frame, the joint having two fasteners disposed along one of the two structural members, a first fastener and a second fastener being repositionable within the joint to be arranged in a staggered position, wherein the one of the two structural members experiences a rotation within the joint corresponding to the staggered position.

7. The sector frame of claim 6, wherein the first fastener is repositionable within an elongated slot.

8. The sector frame of claim 6, wherein the first fastener and the second fastener are U-bolts.

9. The sector frame of claim 1, wherein the base comprises a ballast tray.

10. The sector frame of claim 1, wherein the base is configured for attachment to an extension, the extension operable to reduce a mean contact pressure between the base and the substrate.

11. The sector frame of claim 1, wherein the base is configured for attachment to an extension, the extension operable to increase the resistance of the sector frame to overturning under wind loads.

12. The sector frame of claim 1, wherein the base is configured for attachment to an extension, the extension configured to contain ballast.

13. The sector frame of claim 1, wherein the base is configured for attachment to an extension, the extension forming an extension contact surface with the substrate.

14. The sector frame of claim 1, wherein the base is configured for attachment to an extension, wherein the sector frame and the base have a combined first weight distributed over a first contact area with the substrate to achieve a first mean contact pressure;

wherein, if the extension is attached, the sector frame, the base, and the extension have a combined second weight distributed over a combined second contact area with the substrate to achieve a second mean contact pressure; and wherein the second mean contact pressure is less than the first mean contact pressure.

15. The sector frame of claim 1, wherein the base is configured for attachment to an extension, wherein the sector frame and the base have a combined first weight distributed over a first contact area with the substrate to achieve a first maximum contact pressure at a point along the first contact area;

wherein, if the extension is attached, the sector frame, the base, and the extension have a combined second weight distributed over a combined second contact area with the substrate to achieve a second maximum contact pressure at a point along the combined second contact area; and wherein the second maximum contact pressure is less than the first maximum contact pressure.

16. A sector frame, comprising a plurality of structural members, the plurality of structural members including an antenna pipe for the mounting of electronic equipment and a face pipe along which the antenna pipe is disposed, the antenna pipe and the face pipe forming an antenna pipe array;

a plurality of adjustable joints disposed between a plurality of adjustable structural members selected from the plurality of structural members; and a base forming a base contact surface with a substrate;

wherein the plurality of adjustable structural members includes a first post, a second post, and a tieback pipe, the first and second posts extending upwardly and generally perpendicularly from the base and attaching to the face pipe of the antenna pipe array, the tieback pipe extending at an angle from the base and attaching to the face pipe of the antenna pipe array, wherein the adjustable joints of the sector frame are operable to provide rotation of the entire antenna pipe array in at least two directions selected from:

rotation about a normal axis, the normal axis being normal to the substrate;

rotation about a transverse axis perpendicular to the normal axis; and rotation about a longitudinal axis perpendicular to both the normal axis and the transverse axis, wherein the face pipe of the antenna pipe array is attached to the first post with a first adjustable post joint;

wherein the face pipe of the antenna pipe array is attached to the second post with a second adjustable post joint;

wherein the face pipe of the antenna pipe array is attached to the tieback pipe with an adjustable pipe joint; and wherein the first adjustable post joint, the second adjustable post joint, and the adjustable pipe joint are operable to rotate the antenna pipe array about the normal axis, the transverse axis, and the longitudinal axis.

* * * * *